US005974969A

United States Patent [19]

Okumura et al.

[11] Patent Number: 5,974,969

[45] Date of Patent: Nov. 2, 1999

[54] STAMP UNIT WITH INK PACK FILLED WITH INK

[75] Inventors: Takashi Okumura, Nagoya; Teruo Imamaki, Kasugai; Hiroshi Takami, Nagoya, all of Japan

[73] Assignee: Brother Kogyo Kabushiki Kaisha, Nagoya, Japan

[21] Appl. No.: 09/240,877

[22] Filed: Feb. 1, 1999

[30] Foreign Application Priority Data

Feb. 4, 1998 [JP] Japan ..... 10-023655
Sep. 18, 1998 [JP] Japan ..... 10-264409

[51] Int. Cl.[6] ..... B41F 31/00

[52] U.S. Cl. ..... 101/327; 101/108; 101/333

[58] Field of Search ..... 101/327, 333, 101/334, 97, 98, 101, 103, 104, 108

[56] References Cited

U.S. PATENT DOCUMENTS 4,484,827 11/1984 Price, Jr. ..... 401/205
4,676,162 6/1987 Phipps, Sr. et al. ..... 101/405
5,261,325 11/1993 Bengtsson ..... 101/327
5,377,599 1/1995 Wall et al. ..... 101/327
5,577,444 11/1996 Toyama ..... 101/379
5,694,844 12/1997 Taira ..... 101/125
5,855,170 3/1999 Shih ..... 101/327

FOREIGN PATENT DOCUMENTS 0 798 114 A2 10/1997 European Pat. Off. .
7-149031 6/1995 Japan .
7-257001 10/1995 Japan .

*Primary Examiner*—Edgar Burr
*Assistant Examiner*—Dave A. Ghatt
*Attorney, Agent, or Firm*—Oliff & Berridge, PLC

[57] ABSTRACT

A stamp unit capable of opening an ink pack position between a grip member and a holder member for supplying ink to the stamp material easily in one step. To supply ink to the stamp material, the grip member is pressed downwardly with the ink pack located in the holder member. The ink pack in the holder member is pressed between a thick paper plate and a cutting rib to be opened. Ink from an ink pack flows downwardly through ink holes to be supplied to the stamp material. When the ink runs low, it can be replenished by the simple process of replacing the ink pack.

20 Claims, 17 Drawing Sheets

STAMP UNIT WITH INK PACK FILLED WITH INK

BACKGROUND OF THE INVENTION

1. Field of the Invention

The invention relates to a stamp unit having a holder member which is disposed slidably in an axial direction within a skirt member and holds a stamp material at the lower end portion, and a grip member which is disposed on the upper portion of the holder member and moves the holder member downwardly and, more specifically, to a stamp unit which has an ink pack filled with ink within the holder member and opens the ink pack by the grip member and the holder member, and can supply ink to the stamp material, and also to a method for supplying ink to a stamp unit.

2. Description of the Related Art

Heretofore, several types of stamp units have been proposed. To focus on the method for producing a stamp plate used on such a stamp unit, stamp units will be classified into the following two groups. A type of stamp unit, for example, is disclosed in Japanese unexamined Patent Application Publication Nos. HEI-7-149031, HEI-7-257001. Such a type of stamp unit has a grip portion, a stamp portion and a skirt member, the grip portion and the stamp portion are connected so that the stamp portion can be moved in an axial direction within the skirt member. A stamp material is installed covering the lower surface of an ink impregnated body. The stamp material comprises a thermal porous sheet having a porous substrate adhered to a thermoplastic film.

In the case of producing a stamp plate capable of printing characters and the like from the stamp material using such a stamp unit, the stamp unit is set to a stamp producing apparatus having a thermal head, then the thermal porous sheet of the stamp material is perforated according to the desired characters by controlled heating of the thermal head, thereby the stamp plate is produced. After that, when printing characters and the like, if the grip portion is pressed downward under the condition that the stamp unit is disposed on the desired position of the printing sheet, ink impregnated by the ink impregnated body attaches to the printing sheet through holes formed on the thermal porous sheet. Thereby, characters and the like can be printed.

Another type of stamp unit is described in European unexamined Patent-Application Publication No. EP 0 798 114 A2, having a grip portion and a holder portion. The holder portion is connected to the grip portion. A stamp surface producing material is provided on the lower surface of the holder portion.

The stamp surface forming material of such a stamp unit comprises a porous resin layer. The porous resin layer is melted and solidified by being heated. So as to process this stamp surface producing material, the stamp surface is exposed by a heating unit, such as a xenon tube or a laser light source, according to desired characters or image data. Thereby, the part of the stamp surface, which is exposed, that which does not include characters or image data, is melted and solidified. On the other hand, the other part of the stamp surface forming material forming the characters or image data, which has neither melted nor solidified, remains as it is. Thereby, the stamp plate is produced of the stamp surface forming material. When printing characters and the like, the grip portion is pressed downward when the stamp unit is properly positioned. Thereby, ink impregnated in the stamp surface forming material is exuded from nonmelted-solidified portion and adheres to the printing sheet printing the characters and the like.

In the first type of stamp unit, ink is impregnated into the ink impregnated body in advance. If characters cannot be printed because of a lack of ink after repeated printing, the stamp unit is disposed of. In this type, the ink impregnated body can be supplied ink only once because of the difficulty of impregnating ink, after use, into the ink impregnated body.

To easily re-impregnate ink, the ink storing portion for storing ink at the stamp portion must be formed separately. The stamp structure must have a capability to supply ink into the storing portion from outside of the stamp unit. As mentioned above, forming the ink storing portion and the ink supply structure complicate the structure of the stamp portion and the cost increases.

Further, in case of printing characters using the second type of stamp unit, it is necessary that ink be impregnated into the nonmelted-solidified portion of the stamp surface forming material by applying ink from outside on the stamp surface of the stamp surface forming material. Using such a method for spreading and impregnating ink means the process of impregnating ink into the stamp surface forming material must be performed very often. Because such a process is very complicated, printing characters cannot be done efficiently.

SUMMARY OF THE INVENTION

Therefore, a first object of the invention is to solve the problems described above, and to provide a stamp unit that supplies ink to the stamp material held by the holder member. An ink pack filled with ink is provided within the holder and the ink pack can be opened by both the grip member and the holder member, and then the ink is supplied to the stamp material. As a result, ink can be supplied to the stamp material easily in one step. The ink can also be supplied by the simple process of replacing the ink pack. Further, a simple method for storing ink in the stamp unit is provided.

The second object of the invention is to provide a stamp unit having a holder member holding a stamp material including a porous resin including the light energy absorbing material, that is capable of passing substantially all of the ink in the ink pack to a porous resin layer, as a stamp material, to thereby execute a predetermined number of stamp printings with the ink pack.

In order to accomplish the first object of the invention, the invention provides a stamp unit comprising a skirt member, a holder member, grip member, and an ink pack. The holder member is slidably disposed in an axial direction, within the skirt member. The holder member holds a stamp material at the lower end portion, the holder member including a bottom portion having at least an ink flow hole opposing the stamp material. The grip member is disposed above the holder member, the grip member moving the holder member downwardly. The ink pack is a bag-shaped pack made of a film material, the ink pack being filled with ink, the ink pack being stored on the bottom portion of the holder member within the holder member. Wherein when the holder member is moved downwardly by said grip member, the ink pack is sandwiched and pressed between the lower end portion of the grip member and the bottom portion of the holder member, and thereby the ink pack is opened.

In the above-described stamp unit, in the case of supplying ink into the stamp material, the grip member is pressed downward when the ink pack is located within the holder member. At this time, the ink pack is pressed between the lower end of the grip member and the bottom portion of the holder member. The ink pack made of film material filled with ink, is opened by pressing between the lower portion of the grip member and the bottom portion of the holder member. Thereby, ink in the ink pack flows downward through the ink flow hole and is supplied to the stamp material. As described above, the ink is supplied to the stamp material easily in one step using an easy to handle ink pack.

Further, if it is necessary to supply ink to the stamp material because ink impregnated in the stamp material runs short by the repeated printing of characters, and the density of printing characters declines, supplying ink becomes possible by the simple process of replacing the bag-shaped pack with a new ink pack.

In a preferred form, the holder member includes a cutting portion disposed on the bottom portion of the holder member, the cutting portion contacting the ink pack. When the ink pack is pressed by the lower end portion of the grip member, the ink pack is opened by cooperation of the lower end portion and the cutting portion, and ink flows from the ink pack into the stamp material through the ink flow hole, impregnating the stamp material with ink.

According to this arrangement, the ink pack can be opened easily and quickly by the cutting portion.

In another preferred form, the cutting portion includes a cutting rib formed in a substantially center position of the bottom portion of the holder member. The ink flow hole is formed around the cutting rib.

According to this arrangement, ink flows from the ink pack opened by the cut rib, to impregnate the stamp material, from the ink flow hole formed around the cut rib. At this time, as the ink flow hole is formed around the cut rib, ink from the ink pack is dispersed all over the bottom portion of the holder member, whereby ink is impregnated over the stamp material uniformly.

In another preferred form, the holder member includes a side wall within the skirt member. A plurality of supporting ribs all disposed on the inner surface of the side wall, the supporting ribs supporting the ink pack in cooperation with the cutting rib, the supporting ribs having the substantially the same height as the cutting rib.

According to this arrangement, as the cutting rib and the support rib have substantially the same height as each other, the ink pack can be provided substantially horizontally in the holder member without being inclined. Therefore, ink flowing from the ink pack does not collect or pool in the holder member when the ink pack is opened. The ink is dispersed substantially uniformly over the bottom portion of the holder member and impregnated throughout the stamp material.

In another preferred form, the holder member includes an ink storing portion for storing ink flowing from the ink pack when the ink pack is opened, the ink storing portion being disposed above the bottom portion of the holder member, the ink storing portion being a space formed between the side wall and the cutting rib.

According to this arrangement, by forming a space between the side wall of the holder member and the cutting rib as an ink storing portion, even if ink flows out immediately when the ink pack is opened, the ink can be prevented from leaking from the holder member.

In order to accomplish the second object of the invention, the stamp unit includes a flat member disposed between the ink pack and the lower end portion of the grip member within the holder member, wherein when the holder member is moved downwardly by the grip member, the ink pack is sandwiched and pressed between the flat member moved by the lower end portion of the grip member and the bottom portion of the holder member, thereby opening the ink pack.

In the above-described stamp unit, the pressing power from the grip member is exerted through the flat member over the ink pack equally. Thereby, the ink pack is pressed between the flat member and the bottom portion of the holder member substantially uniformly.

In another preferred form, the bottom portion of the holder member has a flat shape.

According to this arrangement, the ink pack is pressed both upwardly and downwardly by the flat surface by means of the process of pressing the grip member, thereby the ink remaining, or retained, in the ink pack can be greatly reduced.

In a further preferred form, the holder member includes a cutting portion for cutting the ink pack, the cutting portion being disposed in the ink flow hole, the cutting portion protruding beyond a surface of the bottom portion of the holder member.

According to this arrangement, a cutting means for cutting the ink pack is provided that protrudes beyond the ink pack supporting flat surface, the ink pack can be opened easily. The cutting means is provided within the ink flow hole with the cutting position of the ink pack opposed to the ink flow hole so that ink flows into the ink flow hole quickly. Thereby, the time taken for ink to reach the stamp material can be shortened.

In a further preferred form, the number of ink flow holes is determined corresponding to the size of the holder member.

According to this arrangement, the number of ink flow holes is defined according to the size of the holder member, especially in case of a large holder member. In such a case, ink can be supplied to the side end portion of the stamp material quickly. Therefore, the density of the stamp printing is the same at all points and the time it takes for the ink to reach the stamp material after opening the ink pack is greatly reduced.

In another preferred form, the holder member includes a plurality of the ink flow holes and, at least, a partition member is disposed between the ink flow holes.

According to this arrangement, as partition members are provided between a plurality of the ink flow holes, each ink pack can be prevented from sliding from a predetermined position if an ink pack is used for each ink flow hole.

In yet a further preferred form, the holder member includes at least a positioning protrusion for positioning and fixing the flat member within the holder member, the positioning protrusion being formed on an inner surface of a side wall of the holder member.

According to this arrangement, the flat member is disposed on the upper side of the ink pack with the movement of the flat member in an upward direction regulated by the positioning protrusion. Thereby, the ink pack can be fixed within the holder member. Therefore, the stamp unit can be transported with the ink pack disposed within the holder member.

In further another preferred form, the positioning protrusion is formed having a wedge shape declining downward from the inner surface of the side wall to the inside of the holder member.

According to this arrangement, when placing the flat member in the holder member, the side end portion of the flat member is guided into the holder member smoothly following the shape of the positioning protrusion, allowing the flat member to be placed within the holder member easily.

In yet another preferred form, the flat member is capable of absorbing ink.

According to this arrangement, the flat member absorbs ink that flows from the ink pack and prevents ink from leaking from the stamp unit.

BRIEF DESCRIPTION OF THE DRAWINGS

A preferred embodiment of the invention will be described in detail with reference to the following figures wherein.

DETAILED DESCRIPTION OF THE PREFERRED EMBODIMENTS

Figure 1:
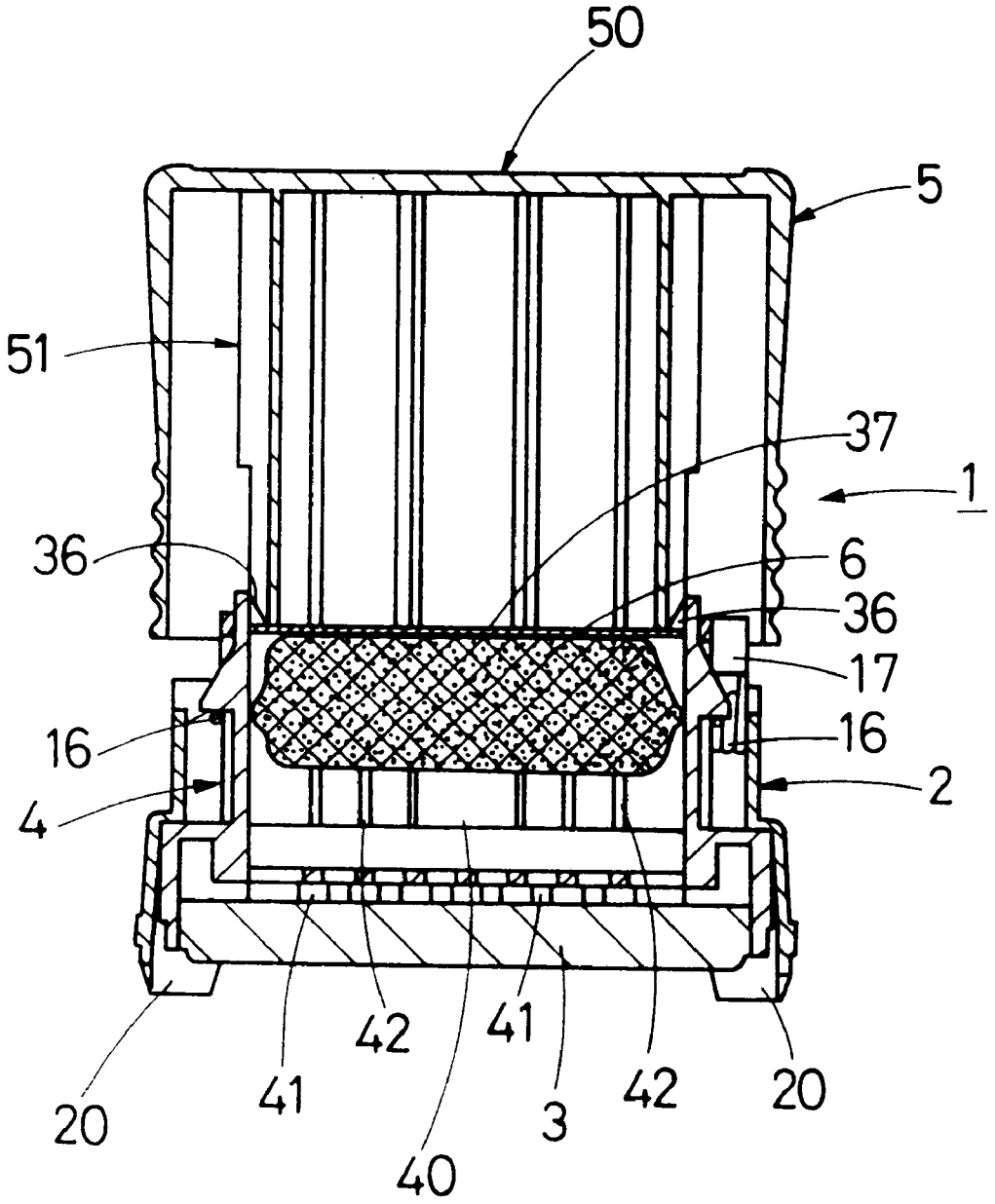
FIG. 1 is a sectional side view of a stamp unit according to a first embodiment before ink is supplied.

A stamp unit according to preferred embodiments of the invention will be described in detail while referring to the drawings. A first embodiment of the stamp unit will first be described.

The structure of the stamp unit will be described referring to FIG. 1. FIG. 1 is a sectional side view of the stamp unit according to the first embodiment before ink is supplied.

As shown in FIG. 1, stamp unit 1 comprises a skirt member 2 supporting the stamp unit 1 while stamp printing is proceeding, a holder member 4 slidably disposed within the skirt member 2 for movement in an up and down (defined as axial) direction and holding a print member 3 at a lower end portion, a grip member 5 moving the holder member 4 downwardly and pressing the print member 3 against a printing sheet (not shown), and a bag-shaped ink pack 6 filled with ink. The ink pack 6 is made from a film material. Polyethylene, polypropylene, polyester, nylon, for example, can be used as the film material. The film made from one of these materials alone or made by laminating two or more kinds of these materials can be used as the ink pack 6.

Figure 2:
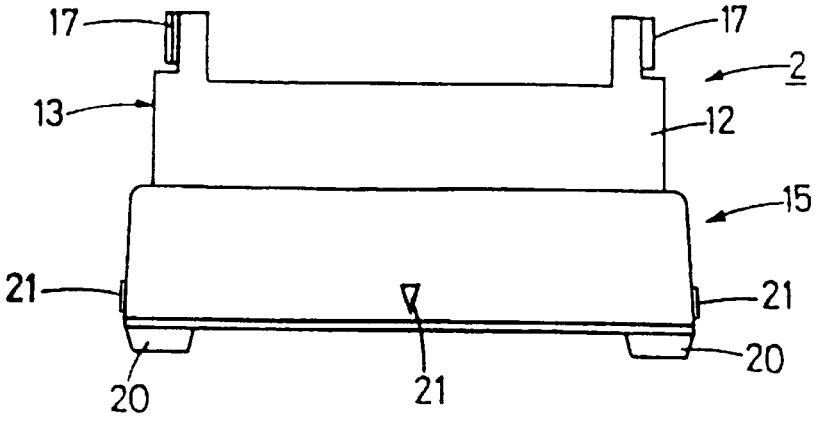
FIG. 2 is a side view of a skirt member.
Figure 3:
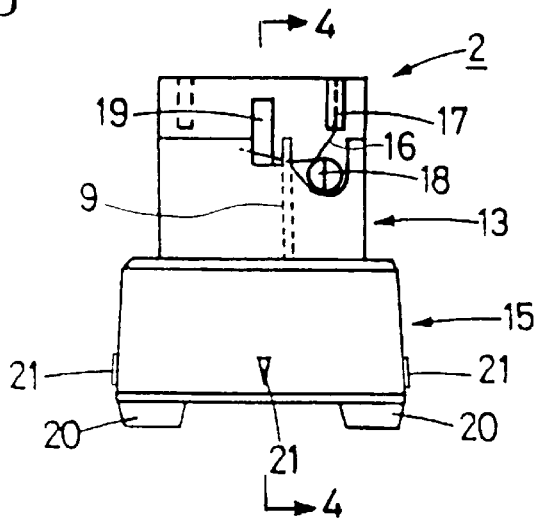
FIG. 3 is an end view of the skirt member.
Figure 4:
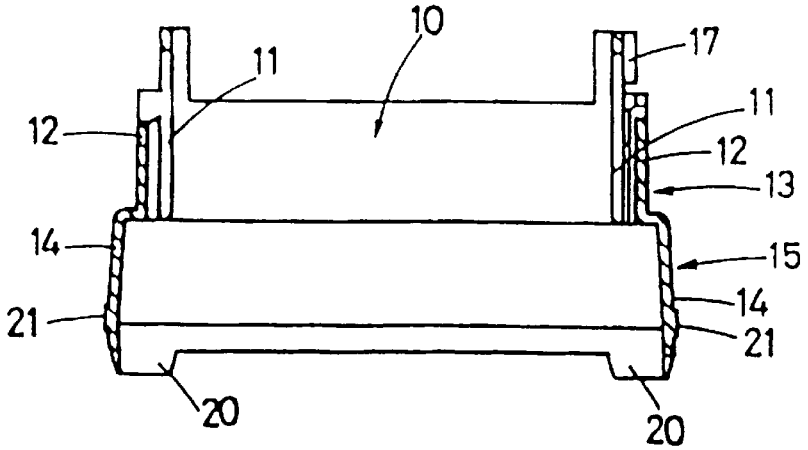
FIG. 4 is a sectional side view of the skirt member.

The skirt member 2 will be described using FIGS. 1 through 4. FIG. 2 is a side view, FIG. 3 is an end view, and FIG. 4 is a sectional side view of the skirt member 2.

As shown in the figures, the skirt member 2 has a rectangularly shaped opening portion 10 and an inner wall 11. The holder member 4 slides relative to the surface of the inner wall 11 within the opening portion 10. The skirt member 2 is integrally composed of an upper skirt portion 13 and a lower skirt portion 15. The upper skirt portion 13 has an outer wall 12 formed with the inner wall 11 but outside the inner wall 11. The lower skirt portion 15 has an outer wall 14 formed continuously to the outer wall 12 in a stepped relationship to have a larger circumference.

A spring engaging portion 17, which engages an end of a torsion spring 16, is formed at the upper portion of the inner wall 11 at both the left and right end surfaces of the upper skirt member 13. A positioning protrusion 18, which has a half-moon shape, receives the coil portion of the torsion spring 16. The positioning protrusion 18 is formed below and inclined or offset from the spring engaging portion 17 (FIG. 3). Further, a vertical groove 19, which receives slidably therein an inclined rib 35 (described hereinafter, FIGS. 5–7) is formed in both of the end surfaces of the holder member 4 at the center portion of the inner wall 11. The vertical grooves 19 act to guide ribs 35 of the holder member 4 in the axial direction when the holder member 4 is moved downward while printing. A spring shift suppression member 9 has an aperture portion (not shown), to prevent disengagement of the torsion spring 16, through which the other end of the torsion spring 16 passes. Further, the lower end of the inclined rib 35 engages the other end of the torsion spring 16 during up and down movement to regulate that movement as the torsion spring 16 end moves in the aperture portion spring shift suppression member 9. The spring shift suppression member 9 is provided between the vertical groove 19 and the positioning protrusion 18.

The lower skirt portion 15 is set on the print sheet and supports the stamp unit 1 while a stamp printing is proceeding. Support ribs 20 support the lower edge of the outer wall 14 keeping it away from surface of the print sheet and are disposed at lower corner portions of outer wall 14. A down arrow 21, which shows a stamp printing direction, is formed at the center portion of the outer wall 14.

Figure 5:
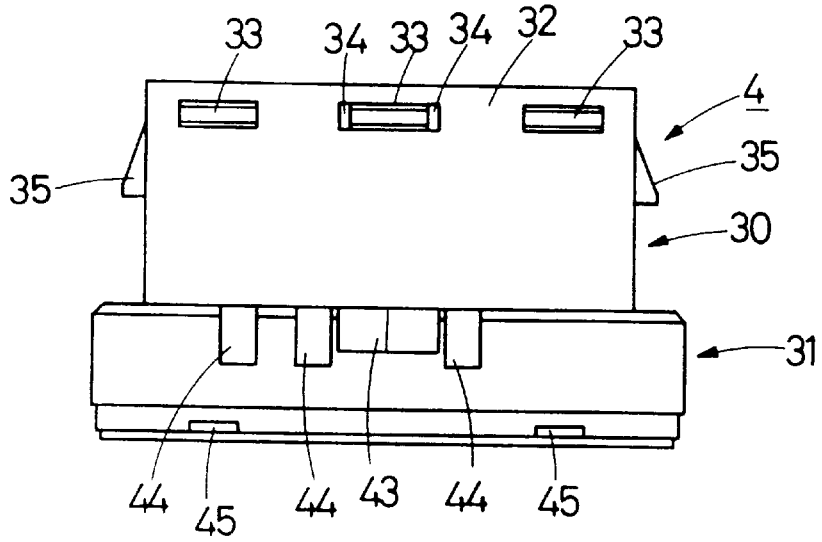
FIG. 5 is a side view of a holder member.
Figure 6:
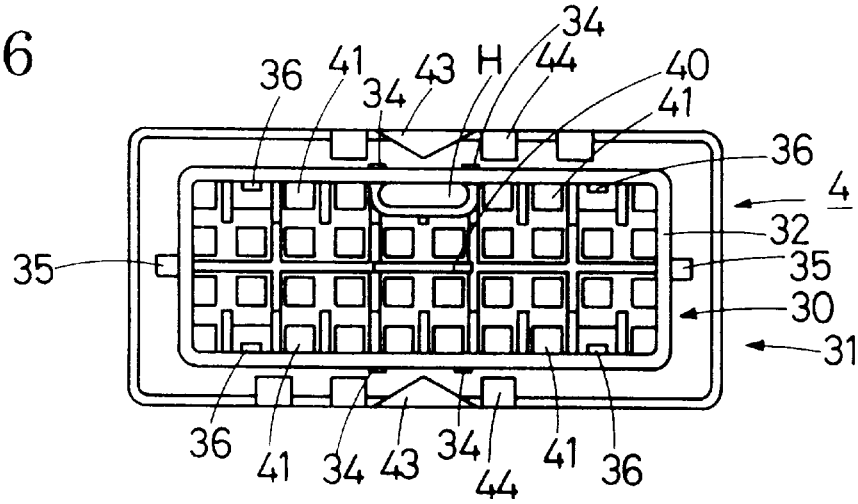
FIG. 6 is a top view of the holder member.
Figure 7:
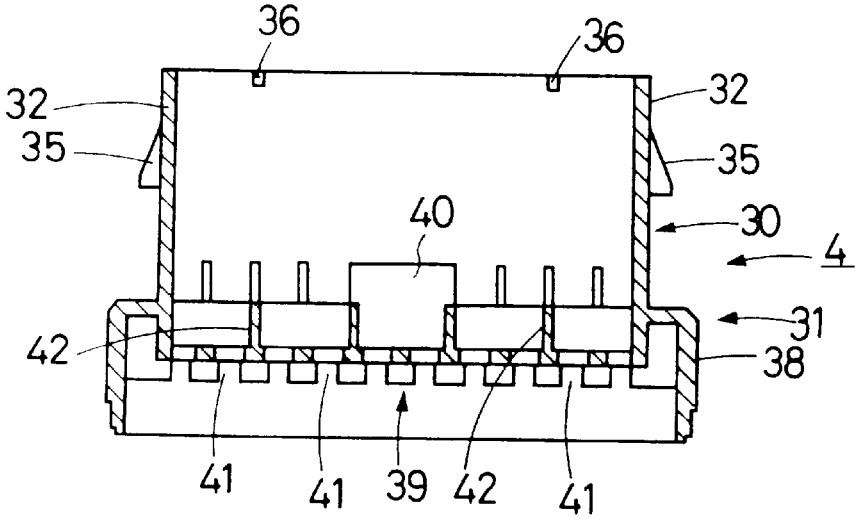
FIG. 7 is a sectional side view of the holder member.

The holder member 4 will be described using FIGS. 1 and 5 to 7. FIG. 5 is a side view, FIG. 6 is a top view, and FIG. 7 is a sectional side view of the holder member 4. As shown in the figures, the holder member 4 is complementary to the upper skirt portion 13 and the lower skirt portion 15 respectively of the skirt portion 2 in shape. The holder member 4 comprises an upper holder portion 30 and a lower holder portion 31 as single body. The upper holder portion 30 includes a side wall 32 which has a substantially rectangular circumferential shape when viewed from above. Three grooves 33 are provided in line horizontally at the upper portion of the front side wall and the rear side wall of the circumferential side wall 32. A regulating protrusion 34, which is wedge-shaped and inclined from the surface of the side wall 32 to narrower away from the surface, is provided at the both ends of center grooves 33. A rib protrusion 54 (to be described hereinafter) of the grip member 5 is fitted into each groove 33. Therefore the holder member 4 and the grip member 5 are connected to form a body. The regulating protrusions 34 contact the upper edge of the outer wall 12 of the upper skirt portion 13 of the skirt member 2 and act to regulate the amount of the downward movement of the holder member 4.

The inclined rib 35, which is wedge-shaped and inclines outwardly in the axial direction from the surface of the circumferential side wall 32, is provided at the each end wall of the circumferential side wall 32 (the left and right end surfaces as shown in FIG. 5) of the upper holder portion 30. The inclined ribs 35 are inserted into the vertical grooves 19 of the upper skirt portion 13 to be slidable in the axial direction when the holder member 4 is inserted from the bottom of the skirt member 2. As shown in FIG. 1, the other end of the torsion spring 16 is fixed at the lower end of the inclined rib 35 (at each end of the stamp unit 1). The holder member 4 is supported to be slidable in an axial direction within the skirt member 2 by cooperation between the inclined ribs 35 and the vertical grooves 19. One end of the torsion spring 16 is engaged by the spring engaging portion 17 of the upper skirt portion 13, and the other end of the torsion spring 16 is engaged by the lower end of inclined rib 35. The holder member 4 is always energized upwardly within the skirt member 2. Two protrusions 36, which are wedge-shaped with a downward inclination away from the inner surface to provide a lower lip, are provided on the inner surface of the front and rear walls of the circumferential side wall 32 (shown at the top and bottom of the circumferential side wall 32 in FIG. 6). As shown in FIG. 1, the protrusions 36 act to regulate the movement of the thick paper plate 37 in an upward direction. The thick paper plate 37 is on the upper side of the ink pack 6 inserted into the holder member 4.

As shown in FIG. 1, the thick paper plate 37 transmits the pressing power from the grip member 5 to the ink pack 6 substantially uniformly by cooperation with the protrusions 36 when the holder member 4 is moved downwardly by the grip member 5 with the ink pack 6 mounted within the holder member 4. The thick paper plate 37 is disposed on the upper side of the ink pack 6 with the movement of the thick paper plate 37 in the upward direction limited by the protrusions 36. Thus, the ink pack 6 is fixed within the holder member 4. Therefore, the stamp unit 1 can be transported under the condition that the ink pack 6 is disposed within the holder member 4. Further, since the thick paper plate 37 is capable of absorbing ink, as described hereinafter, the thick paper plate 37 can absorb ink that flows from the ink pack 6 to prevent the ink from leaking outside of the stamp unit 1 when the ink pack 6 has been opened.

As shown in FIG. 6, an oval-shaped ink supply hole H is provided adjacent one of the front wall or the rear wall of the circumferential side wall 32. The ink supply hole H is used for supplementally supplying ink when the amount of ink supplied from the ink pack 6 is decreased. In such a case, ink is poured through ink supply hole H when the grip member 5 is detached. The thick paper plate 37 has a complementary opening so as not to close the ink supply hole H.

The lower holder portion 31 is formed continuously from the upper holder portion 30 as one body and has a circumferential side wall 38 which is larger than the circumferential side wall 32.

The upper holder portion 30 has a bottom portion 39 within the lower holder portion 31. As shown in FIG. 6, the bottom portion 39 is composed of lattice-shaped ribs. A cutting rib 40 is formed substantially at the center of the bottom portion 39. A plurality of ink flow holes 41 are formed around the cutting rib 40. The holder member 4, including the cutting rib 40, is composed of polyolefine resin, or a PC resin, such as ABS resin, polyacetal copolymer, polypropylene, or nylon. When the grip member 5 is pressed downward, the cutting rib 40 presses into the ink pack 6 which is held in place by the thick paper plate 37, thereby breaking open the ink pack 6. To surely open the ink pack 6, the corner portions of the cutting rib 40 are sharp. As shown in FIG. 1, the ink flow holes 41 oppose the stamp material of the print member 3 and act to guide ink flow from the ink pack 6 downwardly. The ink is impregnated into the stamp material of the print member 3. The supporting ribs 42 are formed with the holder member body to extend outwardly from each of the inner surfaces of front wall and the inner surface of the rear wall of the circumferential side wall 32. The cutting rib 40 has approximately the same height as the supporting ribs 42. As the cutting rib 40 and the supporting ribs 42 are the same height, the ink pack 6 is maintained or housed approximately horizontally without inclination or being biased before opening. Although ink flows at once when the ink pack is opened by the cutting rib 40, a space formed between the circumferential side wall 32 and the cutting rib 40 acts as a storing portion for ink flowing from the ink pack 6. Therefore, even though ink flows at a time when the ink pack 6 is opened, it is prevented from leaking outside of the holder member 4.

Inclined grooves 43 are formed, having an inwardly directed wedge shape at the center position of the front and rear walls of the circumferential side wall 38 constituting the lower holder portion 31. One or two detecting grooves 44 are formed beside the inclined grooves 43. The inclined grooves 43 are used to set the holder member 4 in a predetermined processing position for a stamp producing apparatus when a stamp is formed in the stamp material 3 using the stamp producing apparatus. An example of such is disclosed in European unexamined Patent-Application Publication No. EP 0 798 114 A2, the disclosure of which is incorporated by reference herein. As both sides of inclined grooves 43 are inclined surfaces, the holder member 4 is moved to ensure the position fixing member contacts the center portion of the inclined grooves 43 based on the cam effect between the positioning member of the positioning mechanism and the inclined surfaces. Therefore the holder member 4 is set to a predetermined processing position.

The number of grooves and the position of the detecting grooves 44 differ based on the size of holder member 4. The detecting grooves 44 are used for specifying the size of holder member 4 and work in cooperation with a groove sensor disposed in the positioning mechanism of the stamp producing apparatus. The forming position of the inclined grooves 43 and the detecting grooves 44 on the surface of the circumferential side wall 38 is set to be symmetrical when in the forming position and opposed to the positioning member and positioning sensor regardless of which wall surface having the inclined groove 43 and detecting grooves 44 is in opposition. This makes it possible to process the stamp material 3 even if what is thought of as the front wall is set away from and the rear wall of the holder member set to the predetermined processing position by the positioning mechanism of the stamp producing apparatus.

As shown in FIG. 5, a pair of engaging protrusions 45 are formed at the lower position of the front and rear walls of the circumferential side wall 38. The engaging protrusions 45 engage with engaging grooves 62 of a cap member 60 and are used for providing the cap member 60 to cover the lower end of the lower holder portion 31. The stamp surface of the stamp material of the print member 3 is supported on the lower end of the side wall 38.

The stamp material of the print member 3 is formed having a two layer structure, an upper layer made of a hard porous resin (for example, polyvinyl formal) and a lower layer made of a soft porous resin (urethane resin) dispersed with light energy absorbing materials, such as carbon black. To produce a stamp surface by processing such a stamp material of the print member 3 requires the following steps. First, a positive copy is made by printing characters or images using a thermal head and an ink transfer ribbon onto an opposing portion of a roll-shaped transparent film housed within the stamp producing apparatus. The holder member 4 is set to the predetermined processing position with a transparent acrylic plate between the positive copy produced and the stamp material of the print member 3 such that the positive copy faces the lower layer of the stamp material of the print member 3 when positioned as described above. The lower layer of the stamp material of the print member 3 is lighted or exposed through the positive copy by a light emitting member, such as a xenon bulb. Thereby, only the lower layer corresponding to the transparent part of the positive copy is lighted and melted by the heat of the light energy absorbing material and solidified. On the other hand, the non-melted portion of the lower layer of the stamp material of the print member 3 is left according to the shape of the characters and the like. Thereby, the stamp plate is formed on the lower surface of the stamp material of the print member 3.

Figure 8:
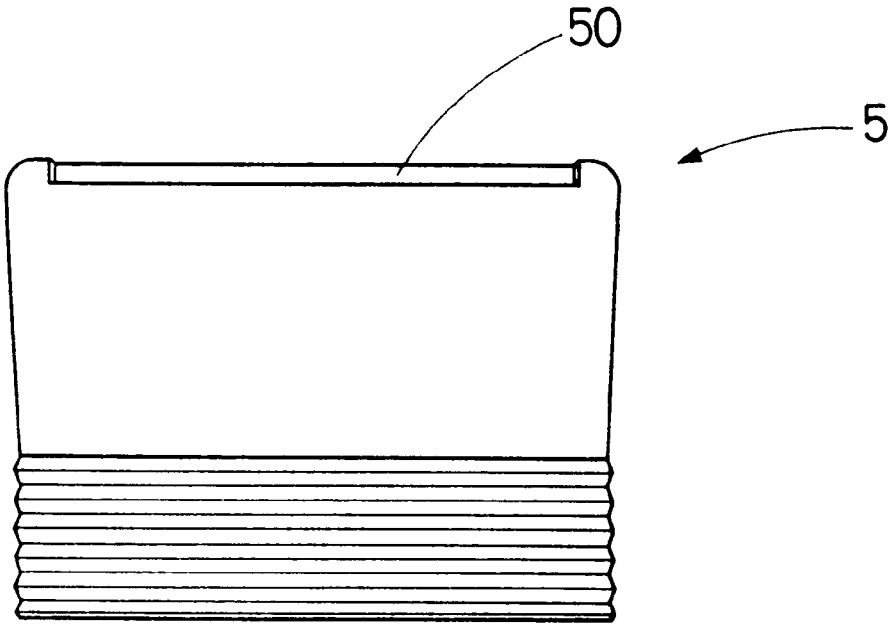
FIG. 8 is a side view of a grip member.
Figure 9:
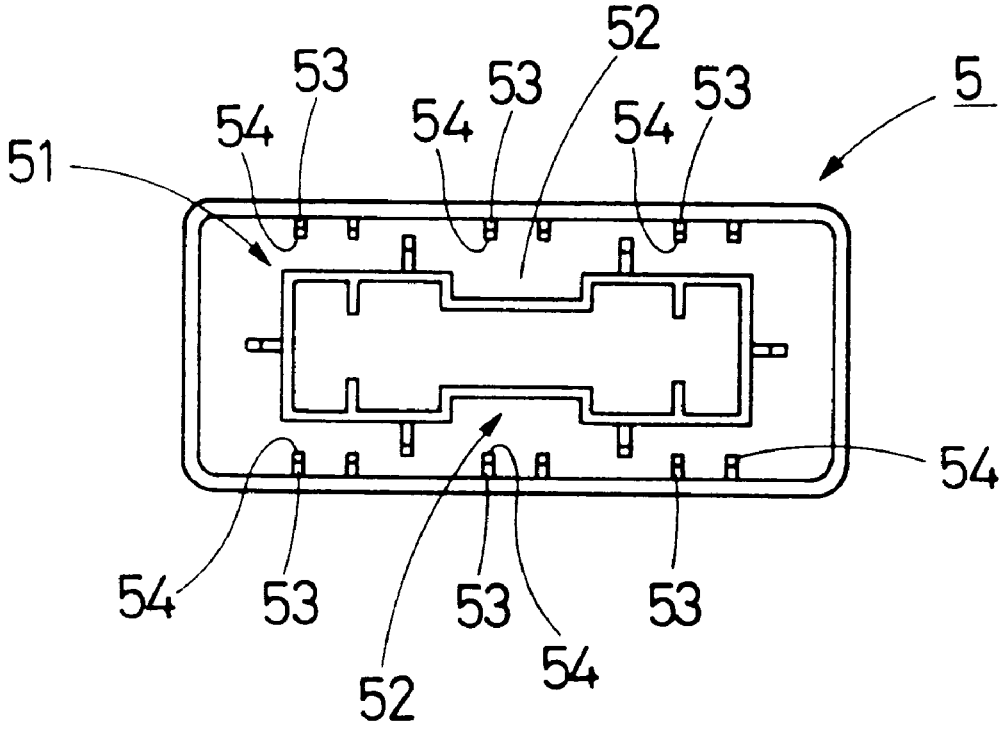
FIG. 9 is a bottom view of the grip member.
Figure 10:
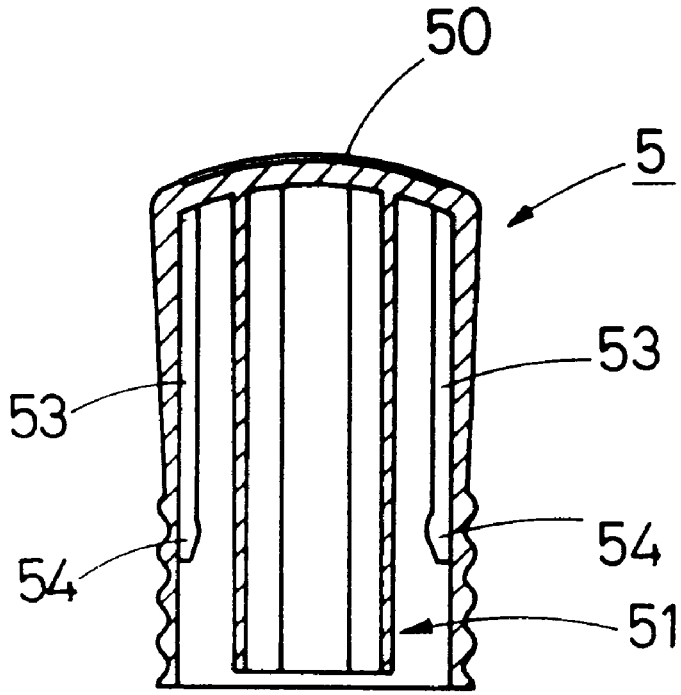
FIG. 10 is a sectional view taken in a transverse direction of the grip member.

Next, the grip member 5 will be described with reference to FIGS. 1 and 8 to 10. FIG. 8 is a side view, FIG. 9 is a bottom view, and FIG. 10 is a transverse sectional view of the grip member 9.

In the figures, a label portion 50 is formed on the upper surface of the grip member 5. A label, which indicates the contents of the stamp formed on the stamp material 3 by the previously described method, is pasted on the label portion 50. Further, an insertion portion 51, which is inserted into the circumferential side wall 32 of the upper holder portion 30 of the holder member 4, is formed on the inside surface of the top of the grip member 5 as shown in FIGS. 1, 9 and 10. The insertion portion 51 acts to press against the ink pack 6, disposed in the holder member 4, through the thick paper plate 37 as described above. The insertion portion 51 has a substantially rectangular shape when viewed from the bottom as shown in FIG. 9. The concave portions 52 are formed at opposed positions at the center peripheral portion of the insertion portion 51. The concave portions 52 permit the insertion portion 51 to bypass the wall portion forming the ink supply hole H disposed on a surface of the circumferential side wall 32 when the insertion portion 51 of the grip material 5 is inserted into the circumferential side wall 32 of the holder member 4. The reason for a pair of concave portions 52 is to prevent the wall portion of the ink supply hole H from being an obstacle and allow the grip member 5 to be inserted with either side opposing the ink supply hole H. Further, a plurality of ribs 53 are formed in a vertical direction on the inner surface of the outer wall of the grip member 5. A rib protrusion 54 is integrally formed at the lower end of each rib 53. A rib protrusion 54 is received in an opposed groove 33 formed on the upper surface of the outer wall of the circumferential side wall 32, whereby the holder member 4 and the grip member 5 are integrated or assembled.

Figure 11:
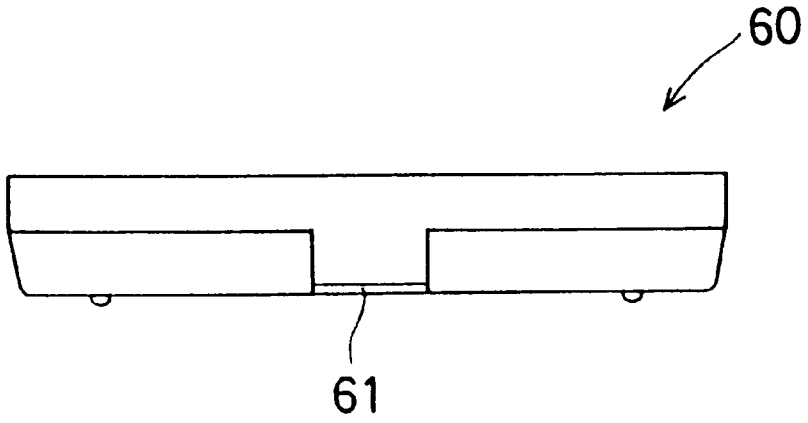
FIG. 11 is a side view of a cap member.
Figure 12:
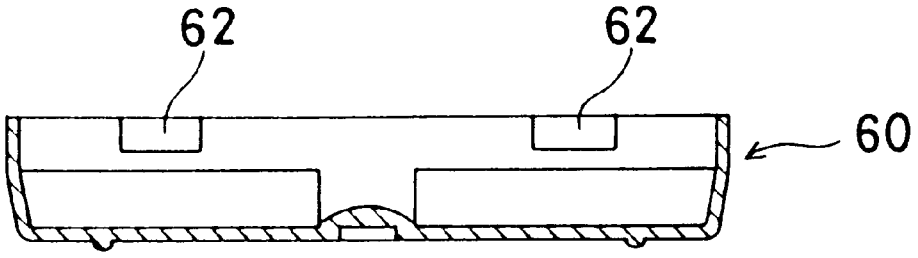
FIG. 12 is a sectional side view of the cap member.

Next, the cap member 60 disposed at the lower end portion of the lower holder portion 31 of the holder member 4 will be described with reference to FIGS. 11 and 12. FIG. 11 is a side view, and FIG. 12 is a sectional side view of the cap member 60. As shown in the figures, the cap member 60 is box-shaped having an opening upward. The hand holding portion 61, which is held by the operator's fingers when fixing the cap member 60 onto or detaching from the holder member 4, is formed substantially at the center portion of both sides of the surface of the outer wall, as shown in FIG. 11. Further, a pair of engaging grooves 62, which are engaged with the engaging protrusions 45 formed on the circumferential side wall 38, is provided on both sides of the inner surface of the peripheral wall of the cap member 60. The cap member 60 is attached to the circumferential side wall 38 by each engaging groove 62 of the cap member 60 being engaged with an opposed engaging protrusion 45 of the side wall 38. Thereby, the stamp surface of the stamp material of the print member 3, which is located near the lower end of the circumferential side wall 38 is protected by the cap member 60.

In order to produce the stamp unit 1, first, the stamp plate is produced by processing the stamp material of the print member 3. For that, the holder member 4, which has the ink pack 6 therein, topped by the thick paper plate 37 retained by the positioning protrusions 36, is set to the predetermined processing position of the stamp producing apparatus by the cam action between the inclined surface of the inclined groove 43 formed at the lower holder portion 31 and the opposed positioning member of the positioning mechanism. Further, the size of the holder member 4 is specified by the detecting grooves 44 in cooperation with the groove sensor disposed in the positioning mechanism.

As the thick paper plate 37 is provided on the upper side of the ink pack 6 with further upward movement prevented by the positioning protrusions 36, the ink pack 6 is fixed to a certain degree within the holder member 4. Therefore, no problem occurs when the holder member is transported with the ink pack 6 mounted within the holder member 4. Further, as the cutting rib 40 and the support ribs 42 have substantially the same height, the ink pack 6 is maintained substantially horizontally without being inclined or otherwise incorrectly seated.

After the holder member 4 is set to the predetermined processing position, the roll-shaped transparent film is transported within the stamp production apparatus, at the same time character and image data are printed by the thermal head and the ink transfer ribbon onto the transparent film to create a positive copy. The positive copy and the stamp material 3 are set so as to oppose each other with a transparent acrylic plate provided between them. When a light emitting member, such as a xenon tube, emits light opposite the nonprinted portion of the transparent tape, the lower portion of the stamp material of the print member 3 is illuminated or exposed. Thereby, only the portion of the stamped material, which is lighted according to the nonprinted or transparent portion of the positive copy, is melted and solidified. On the other hand, the lower portion of the stamp material 3, which is not melted or solidified, remains as it is according to characters and the like of the positive copy. Thus, the stamp plate is produced on the lower surface of the stamp material of the print member 3.

After the stamp material of the print member 3 is processed, the coil portion of the torsion spring 16 is positioned on the positioning protrusion 18. Also, the holder member 4 is inserted into the opening portion 10 of the skirt member 2 such that the spring engaging portion 17 is engaged with an end of the torsion spring 16. At this time, the inclined protrusions 35, one formed on each end wall of the circumferential side wall 32 of the upper holder 30 of the holder member 4, is slid upward in the vertical groove 19 of the skirt member 2. Further, the other end of the torsion spring 16 is engaged with the lower portion of the inclined protrusion 35 when the inclined protrusion 35 passes over the other end of the torsion spring 16 according to the wedge shape of the inclined protrusion 35. As a result, the holder member 4 is energized upward by the energizing power of the torsion springs 16 within the skirt member 2 and the holder member 4 can slide down opposite to the resistance of the torsion springs 16.

Figure 13:
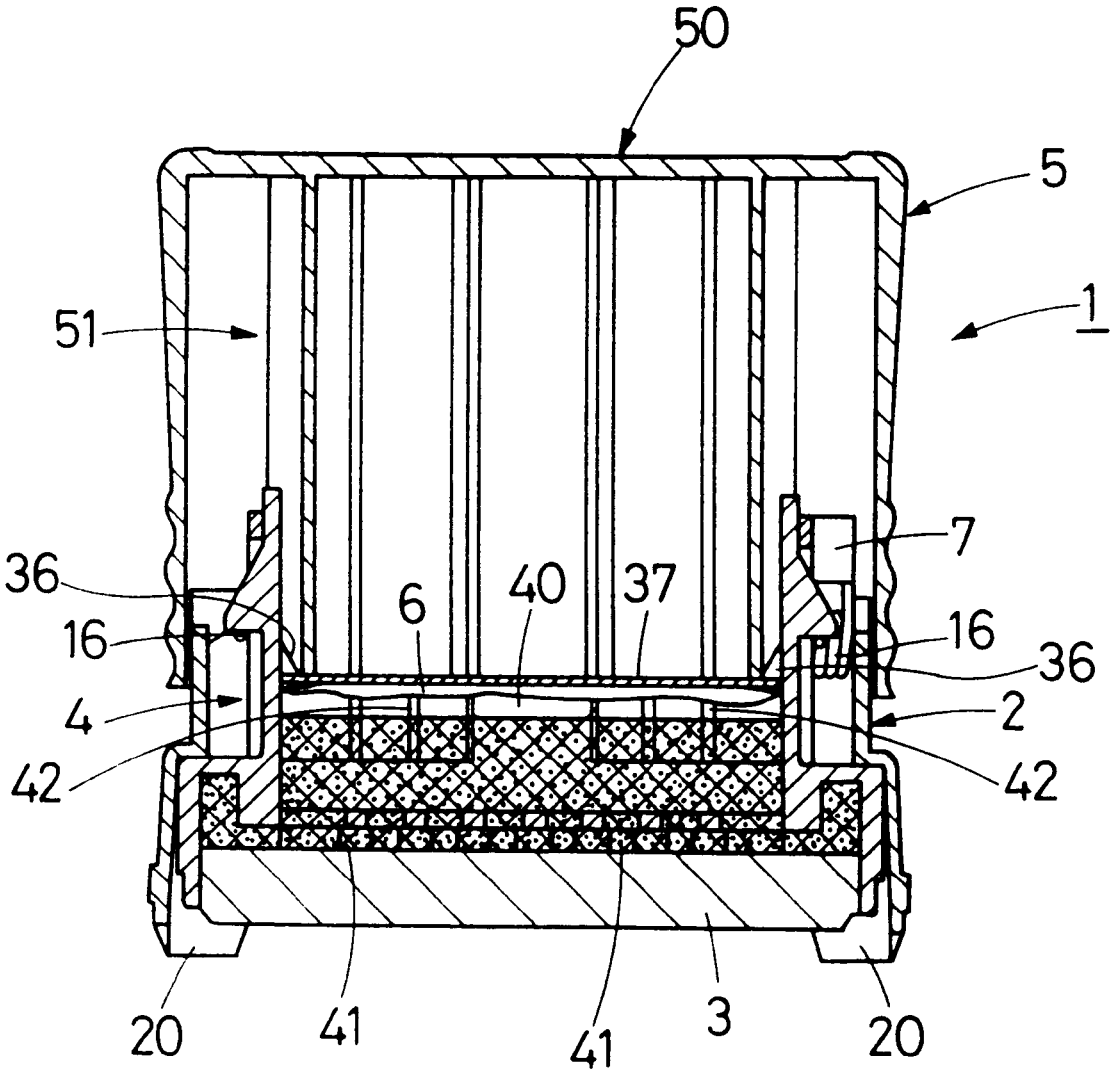
FIG. 13 is a sectional side view of the stamp unit after ink is supplied.

After the holder member 4 and the skirt member 2 are assembled in the manner described above, the inserting portion 51 of the grip member 5 is inserted into the circumferential side wall 32 of the holder member 4. FIG. 1 shows this state. The ink pack 6 in the holder member 4 is sandwiched and pressed between the thick paper plate 37 and the cutting rib 40 and support ribs 42. If the grip member 5 is pressed further after the inserting portion 51 is inserted into the side wall 32, the inserting portion 51 presses the thick paper plate 37, which exerts the pressing power to the ink pack 6 substantially uniformly across the surface. Therefore, the ink pack 6 is cut and opened at the portion contacting the cutting rib 40 opening the ink pack 6 substantially at the center position and the ink flows from the ink pack 6 to be dispersed around the cutting rib 40 substantially uniformly. Further, as the thick paper plate is capable of absorbing the ink, it absorbs any ink rising above the ink pack 6 and prevents ink from leaking out of the stamp unit 1. FIG. 13 shows this state.

Further, ink flows at once when the ink pack 6 is opened by the cutting rib 40. However, as the space formed between the circumferential side wall 32 and the cut rib 40 is a storing portion for the ink from the ink pack 6, ink leaks are prevented from the holder member 4 even if ink flows at once when the ink pack 6 is opened.

Ink flowing from the ink pack 6 is guided downward by the ink flow holes 41 formed around the cutting rib 40 and impregnates the stamp material of the print member 3. At this time, as the ink flow holes 41 are formed around the cut rib 40, ink from the ink pack 6 is dispersed over the entire bottom portion of the holder member 4 substantially uniformly so the ink impregnates the stamp material of the print member 3 substantially uniformly.

Further, at the time that the ink pack 6 is opened by moving the grip member 5 downward, the rib protrusions 54, which are formed at the lower end of each rib 53 of the grip member 5, are fitted into an opposed groove 33 formed on the circumferential side wall 32 of the holder member 4, thereby connecting the holder member 4 and the grip member 5. Therefore, if users want to perform the stamp printing of characters according to the stamp plate formed on the stamp material of the print member 3, after ink is impregnated into the stamp material of the print member 3 as described above, the grip member 5 and the holder 4 move integrally to perform stamp printing.

Further, if ink impregnated into the stamp material of the print member 3 is used up and, as a result, the stamp printing cannot be obtained at the proper density, the stamp printing can be started again by removing the grip member 5 from the holder member 4, removing the thick paper plate 37 and the used ink pack 6 from the holder member 4, and setting a new ink pack 6 in the holder 4. The stamp unit is then reassembled as previously described. Further, if an ink pack 6 is unavailable, and the ink from another source is available, stamp printing can be started again by supplying ink through the ink supply hole H formed on an inner surface of the circumferential side wall 32 of the holder member 4 without removing the ink pack and the thick paper plate 37.

As described above, to supply ink to the stamp material of the print member 3 of the stamp unit 1 of the present embodiment, the grip member 5 is pressed downward with an ink pack 6 provided in the holder member 4. The ink pack 6, sandwiched between the thick paper plate 37 and the cutting rib 40, is cut open. The ink from the ink pack 6 flows downward through the ink flow holes 41 to be supplied to the stamp material of the print member 3. Thus, ink can be supplied to the stamp material of the print member 3 very easily in one step.

Further, if it is necessary to supply ink to the stamp material of the print member 3 because the ink impregnated into the stamp material of the print member 3 is reduced by repeated stamp printing of the characters image so that the printing density of the characters image is degraded, the stamp printing can be refreshed by supplying ink by replacing the bag-shaped ink pack 6.

Further, as the cutting rib 40 contacting the ink pack 6 and the ink flow holes 41 opposed to the stamp material of the print member 3 are provided, the ink pack 6 can be opened easily and quickly by the cutting rib 40. Also, ink flowing from the ink pack 6 through the ink flow holes 41 impregnates the stamp material of the print member 3 quickly.

Further, ink flowing from the ink pack 6 is guided downward through the ink flow holes 41 formed around the cutting rib 40 to impregnate the stamp material of the print member 3. At this time, as the ink flow holes 41 are formed around the cutting rib 40, ink from the ink pack 6 is dispersed uniformly over the bottom portion of the holder material 4 so that the ink impregnates the stamp material of the print member 3 uniformly.

Further, as the cutting rib 40 and the support rib 42 have substantially-the same height, the ink pack 6 is held substantially horizontally in the holder member 4 without being inclined or otherwise distorted. Therefore, the ink flow from the ink pack 6 is not disrupted, and ink is not retained in parts of the ink pack 6 or unevenly distributed in the holder member 4 when the ink pack 6 is opened. Thus, ink is dispersed uniformly all over the bottom portion of the holder member 4 and uniformly impregnate the stamp material of the print member 3.

Further, ink flows at once when the ink pack 6 is opened by the cutting rib 40. However, as the space formed between the side wall 32 and the cutting rib 40 acts as a storing portion for the ink, it prevents the ink from leaking out of the holder member 4.

Further, when the grip member 5 is moved downward against the thick paper plate 37, the pressing power is exerted substantially uniformly over the surface of the ink pack 6. Therefore, the ink pack 6 is cut and opened at the portion contacting the cutting rib 40. Thereby, the ink pack 6 is opened substantially at a center position according to the position of the cutting rib 40 and ink flowing from the ink pack 6 can be dispersed around the cutting rib 40 substantialily uniformly. Further, because the thick paper plate 37 is capable of absorbing ink, it absorbs ink flowing from the ink pack 6 and prevents the ink from leaking from the stamp unit 1.

Further, as the thick paper plate 37 is provided on the upper side of the ink pack 6 and prevented from excessive upward movement by the positioning protrusions 36, the ink pack 6 is fixed to a certain degree in the holder member 4. Thereby, the holder member can be transported under the condition that the ink pack 6 is arranged within the holder member 4.

Next, a stamp unit according to a second embodiment will be described with reference to FIGS. 14 to 26.

Figure 14:
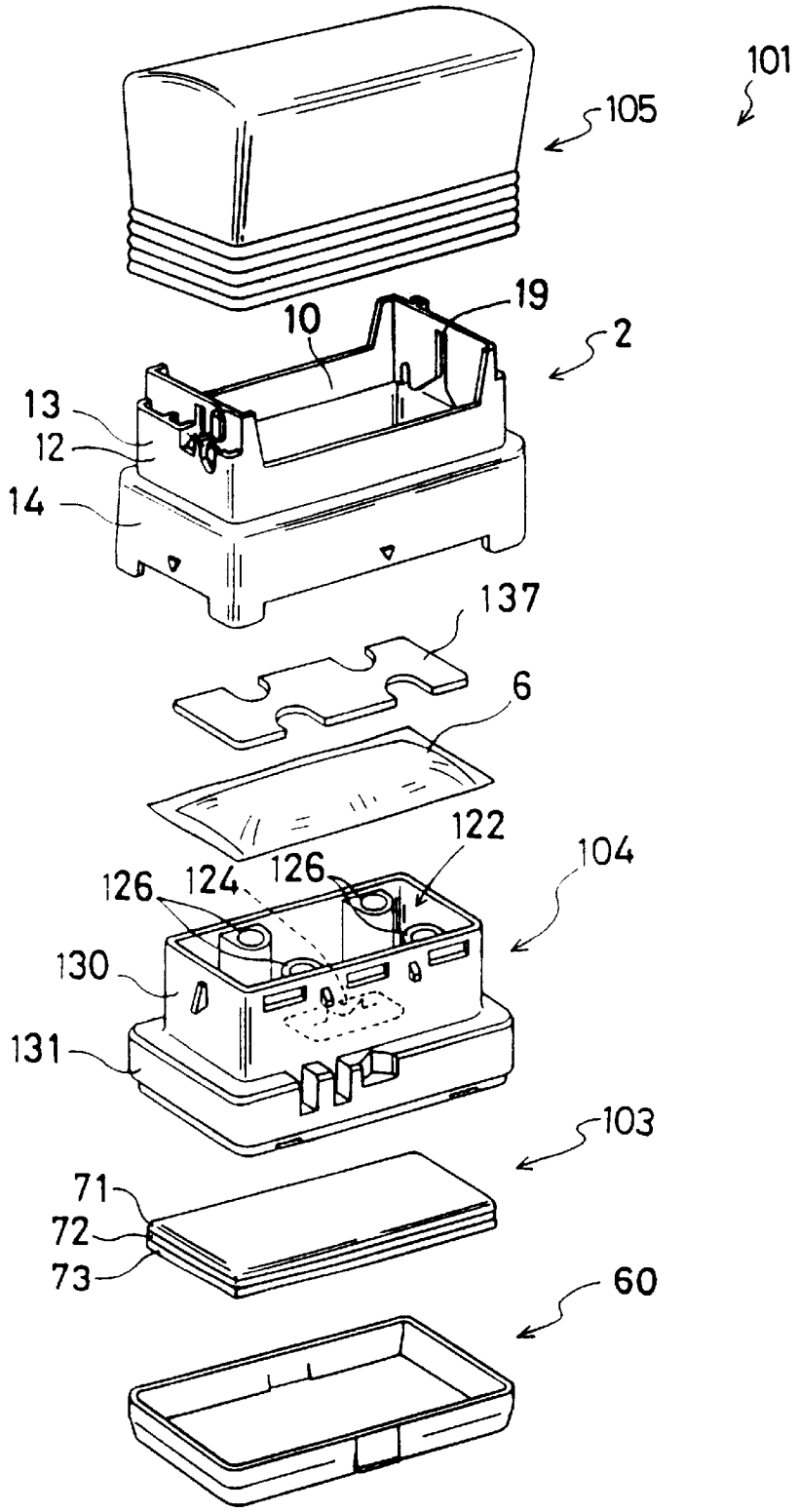
FIG. 14 is a general exploded perspective view of a stamp unit of a second embodiment of the invention.
Figure 15:
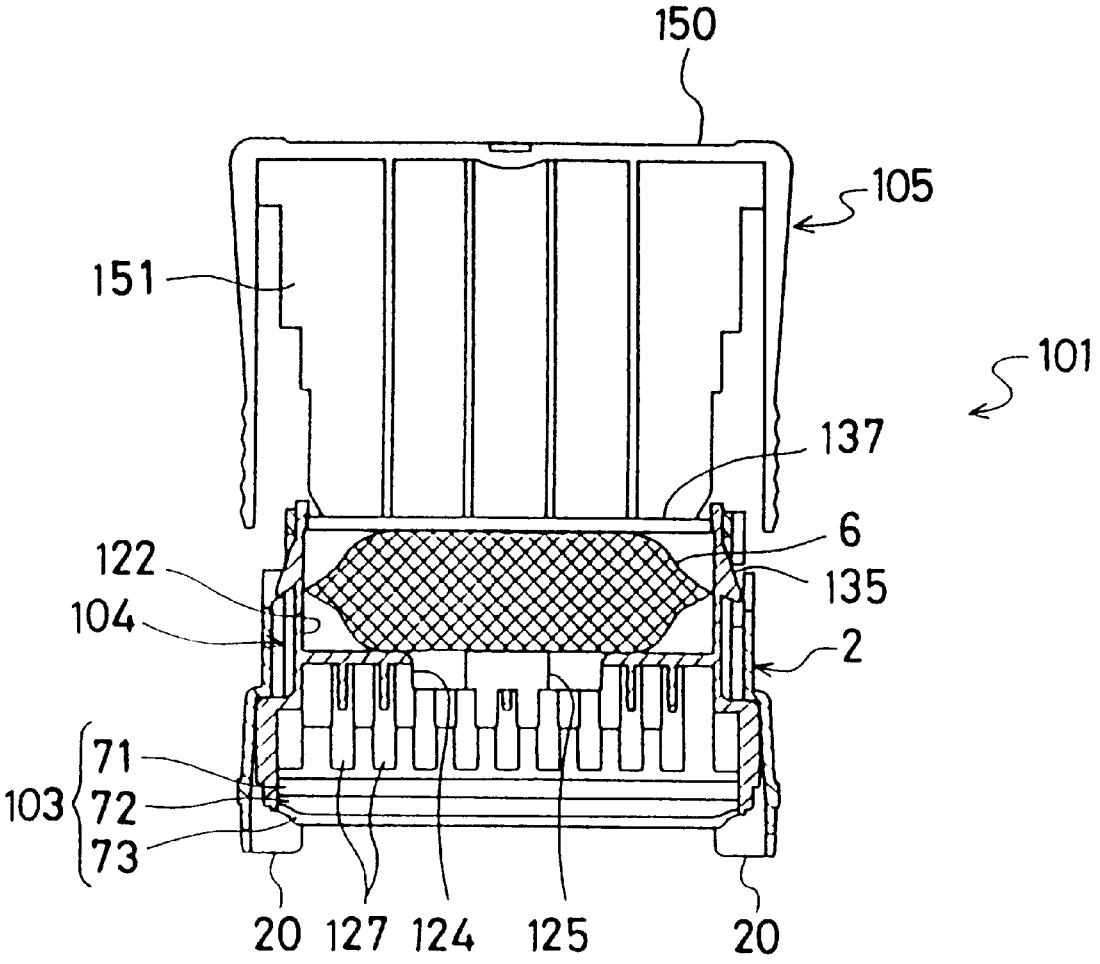
FIG. 15 is a sectional side elevation of the stamp unit of FIG. 14 before the ink pack is opened.
Figure 16:
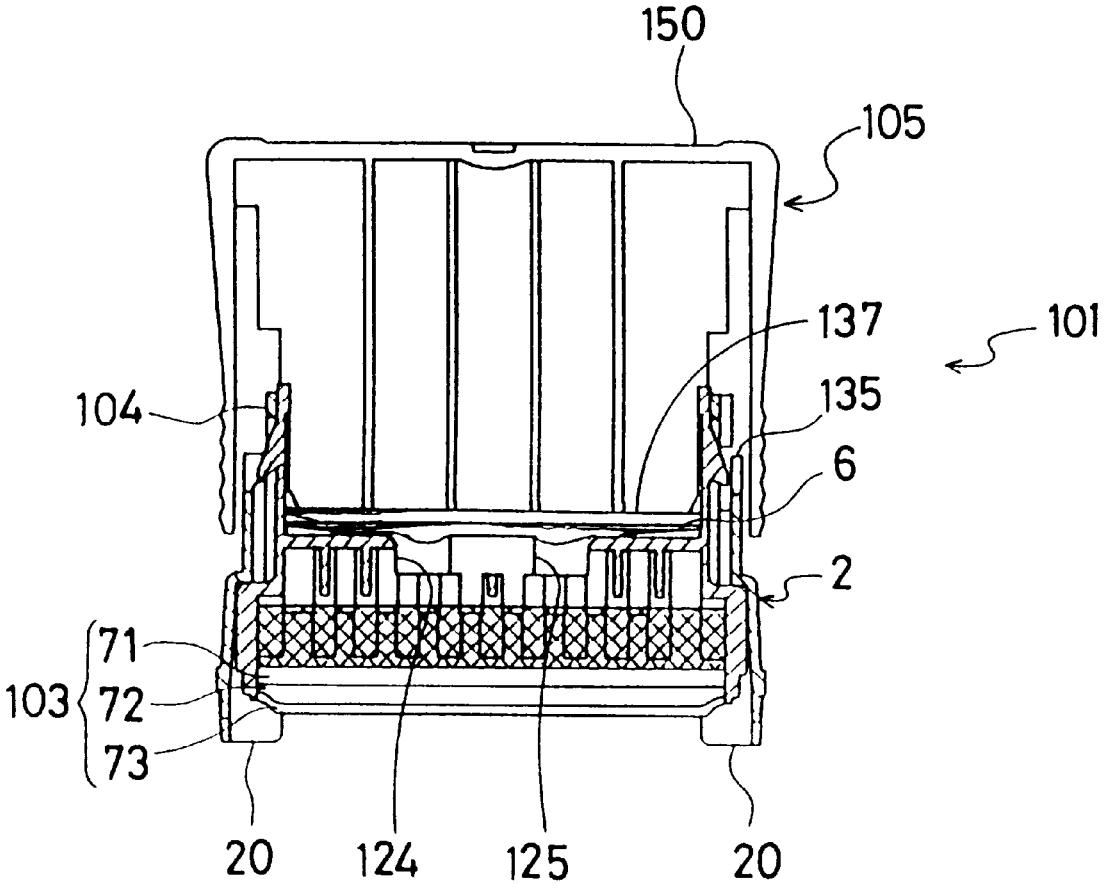
FIG. 16 is a sectional side elevation of the stamp unit of FIG. 14 immediately after the ink pack is opened.

FIG. 14 is an exploded perspective view of a stamp unit 101 of the second embodiment of the invention, FIG. 15 is a sectional side view of the stamp unit 101 storing an unopened ink pack, and FIG. 16 is a sectional side view of the stamp unit 101 immediately after the ink pack is opened. As shown in FIGS. 14 to 16, the stamp unit 101 of the embodiment comprises a skirt member 2 supporting the stamp unit 101 during stamp-printing, a holder member 104 disposed within the skirt member 2 for movement in an axial (up and down) direction and holding a stamp material 103 at a lower end portion that is thermally adhered, a grip member 105 connected to the holder member 104 for moving the holder member 104 downwardly and pressing the stamp material 103 against the printing sheet(not shown), and a cap member 60 for covering and protecting the stamp material 103 mounted to the holder member 104.

An ink pack storing portion 122 of the holder member 104 is capable of storing a bag-shaped ink pack 6 made of a film material and filled with ink. Substantially the same amount of ink as is storable in the stamp material 103 is contained in the ink pack 6. Polyethylene, polypropylene, polyester, nylon, for example, can be used as the film material. The film of one of these materials alone or a film made by laminating two or more of the materials can be used to make the ink pack 6.

The skirt member 2 of the stamp unit 101 is the same as the skirt member 2 of the stamp unit 1 of the first embodiment. Thus, the description of the skirt member 2 as described in detail with reference to FIGS. 2 to 4 applies equally to skirt member 2 of the instant embodiment and will not be repeated.

Figure 17:
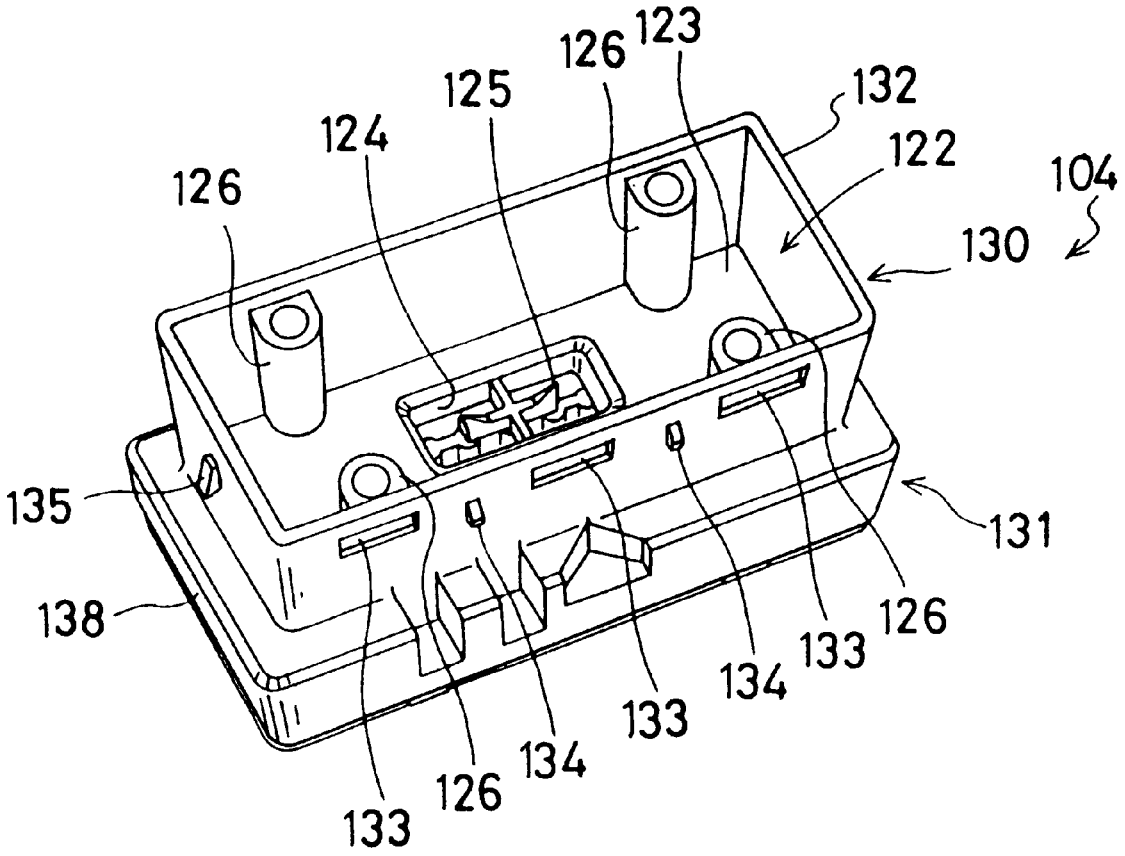
FIG. 17 is a perspective view of the holder member shown in FIG. 14.
Figure 18:
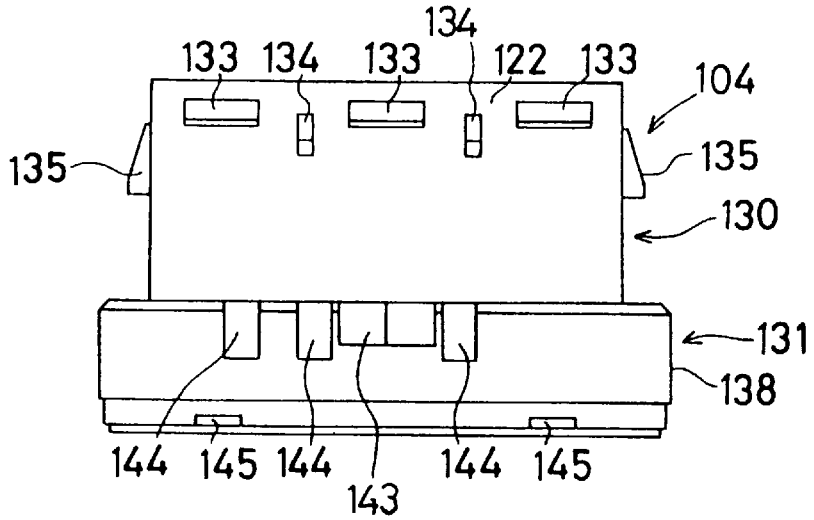
FIG. 18 is a side view of the holder member shown in FIG. 14.
Figure 19:
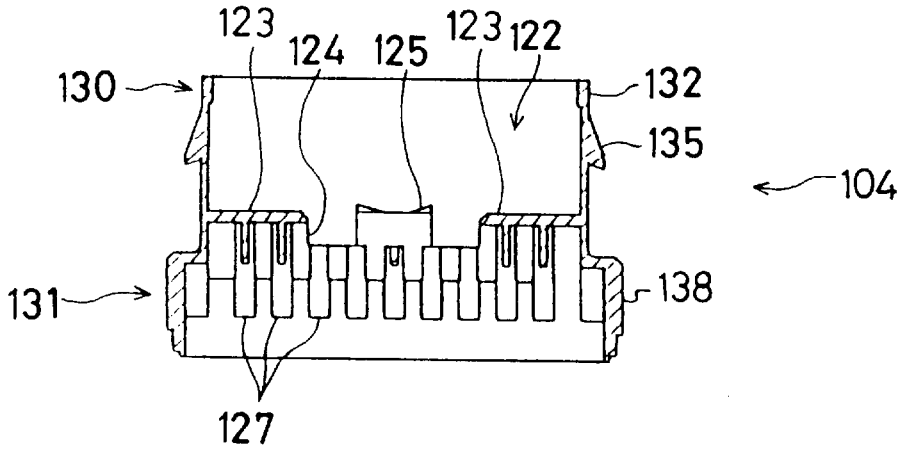
FIG. 19 is a sectional side view of the holder member shown in FIG. 14.
Figure 20:
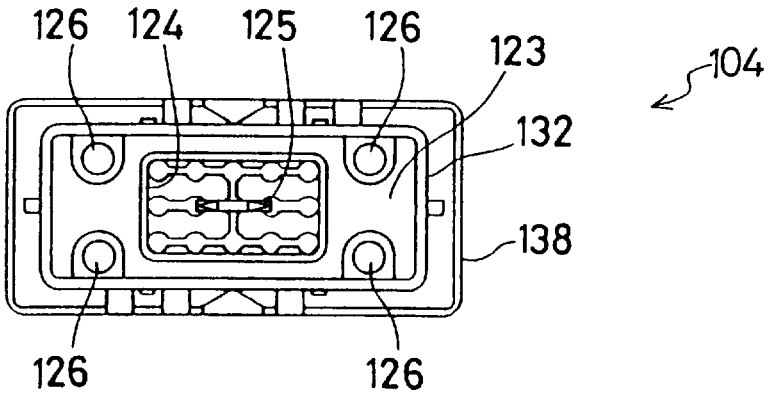
FIG. 20 is a top view of the holder member shown in FIG. 14.
Figure 21:
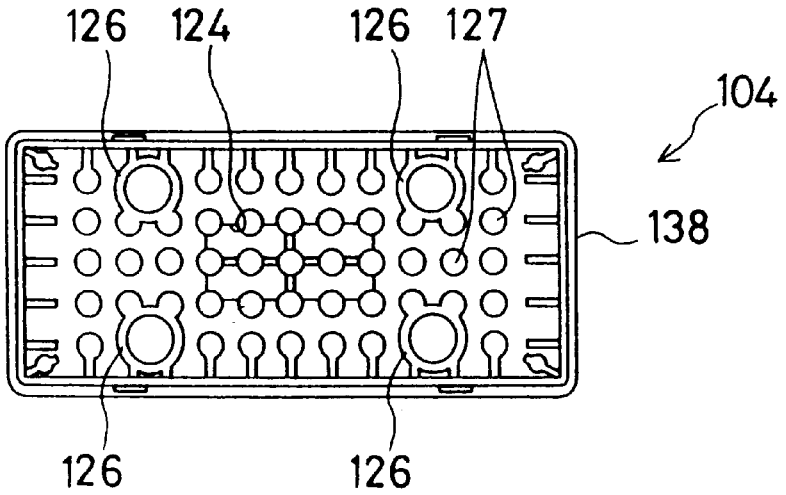
FIG. 21 is a bottom view of the holder member shown in FIG. 14.

The holder member 104 will be described with reference to FIGS. 17 to 21. FIG. 17 is a perspective view, FIG. 18 is a side view, FIG. 19 is a sectional side view of, FIG. 20 is a top view, and FIG. 21 is a bottom view of the holder member 104. As shown in the figures, the holder member 104 is similar to the upper skirt portion 13 and the lower skirt portion 15 of the first embodiment in shape and comprises an upper holder portion 130 and a lower holder portion 131 in a unitary body. The upper holder portion 130 includes a circumferential side wall 132 which has a rectangular shape when viewed from the above. Three grooves 133 are provided in a horizontal line at an upper portion of the front side wall and the rear side wall of the circumferential side wall 132. Regulating ribs 134, which are wedge-shaped and incline downward away from the outer surface of the front and rear sidewalls of the circumferential side wall 132, are provided on both sides of the center grooves 133. The holder member 104 and the grip member 105 can be connected to form a single body. The regulating ribs 134 act to touch the upper end of the outer wall 12 of the upper skirt portion 13 of the skirt member 2 and to regulate the amount of the downward movement of the holder member 104.

Inclining protrusions 135 are wedge-shaped and incline downwardly and outwardly from the outer surface of the end walls of the circumferential side wall 132 of the upper holder portion 130. The inclining protrusions 135 are inserted into the vertical groove 19 of the upper skirt portion 13 to be slidable in the axial direction when the holder member 104 is inserted from the under side of the skirt member 2. As described with respect to the first embodiment, the other end of the torsion springs 16 are fixed at the lower end of respective inclining protrusions 135. The holder member 104 is supported slidably in an axial direction in the skirt member 2 by cooperation of the inclining protrusion 135 and the vertical grooves 19. One end of spring 16 is engaged by the spring engaging portion 17 of the upper skirt portion 13, and the other end is engaged by the lower end of the inclining protrusion 135. Thereby, the holder member 104 is always energized upward in the skirt member 2. This structure is the same as, and is as shown in FIG. 3, described in the discussion of the first embodiment.

An ink pack storing portion 122 is of a substantially rectangular parallelpiped shape being surrounded by the circumferential side wall 132 of the upper holder portion 130 of the holder member 104. The ink pack storing portion 122 has a flat bottom surface 123 with an ink flow hole 124 substantially in the center and connected to the lower holder portion 131. Further, a cutting rib 125, which protrudes a little beyond the bottom surface 123, is provided in the ink flow hole 124 for cutting and opening the ink pack 6.

Four oval-shaped ink supply holes 126, which reach from proximate the top end of the holder member 104 to the bottom surface of support rods 127 (refer to FIG. 21), are provided on the inner surface of the ink pack storing portion 122. The ink supply holes 126 are used to supplement the ink without using an ink pack 6 if the amount of the ink in the stamp material 103 supplied by the ink pack 6 becomes insufficient. Ink is poured through the ink supply holes 126 with the grip member 105 detached.

Further, as shown in FIG. 21, the plurality of support rods 127, which are of several millimeters in length, are provided so as to form a lattice on the lower holder portion 131 of the holder member 104. The support rods 127 extend down from the bottom surface of bottom surface 123 and contact the stamp material 103 held by the holder member 104. The bottom ends of the support rods 127 substantially form a plane. The lower holder portion 131 is integrally formed to the upper holder portion 130 as a unitary body and has a circumferential side wall 138 which is larger than the circumferential side wall 132. The holder member 104 is made of polyoplefine resin such as ABS resin, polyacetal copolymer, polypropylene, nylon, or PC resin.

The cutting rib 125 acts, when the ink pack 6 is pressed downwardly via a thick paper plate 137 by the grip member 105, to cut and open the ink pack 6. The corner portions of the cutting rib 125 are formed to be sharp for reliably opening the ink pack 6. The ink flow hole 124 guides the ink flowing from the ink pack 6, opened by the cutting rib 125, downwardly where the ink impregnates the stamp material 103.

An inclined groove 143 (FIG. 18) is formed having an inwardly directed wedge shape at an outer center position of each longitudinal wall of the circumferential side wall 138 of the lower holder portion 131. One or two detecting grooves 144 are formed at the sides of inclined grooves 143. The inclined groove 143 is used for setting the holder member 104 to a predetermined processing position in a stamp producing apparatus when forming a stamp from the print material 103 using the stamp producing apparatus, for example, such as disclosed in European unexamined Patent-Application Publication No. EP 0 798 114 A2. As both sides of inclined grooves 143 have an inclined surface, the holder member 104 is moved to position the positioning member in a positioning mechanism of the stamp producing apparatus at the center portion of the inclined groove 143 based on a camming action between the positioning member and the inclined surfaces. Thereby, the holder member 104 is set to a predetermined processing position. The number of detecting grooves 144 and the position of the detecting grooves 144 are changed based on the size of holder member 104. The detecting grooves 144 specify the size of holder member 104 in cooperation with a groove sensor which is part of the positioning mechanism of the stamp producing apparatus. The position of the inclined groove 143 and the detecting grooves 144 on the surface of the circumferential side wall 138 are set to have identical position regardless of which longitudinal side of the circumferential sidewall 138 faces the positioning mechanism. This makes it makes possible to process the stamp material 103 regardless how the stamp unit 101 is seated at the predetermined processing position of the stamp producing apparatus.

As shown in FIG. 18, a pair of engaging protrusions 145 are formed on the lower position of the longitudinal walls of the circumferential side wall 138. The engaging protrusions 145 engage engaging grooves 62 of the cap member 60 (see FIG. 12) and are used to attach the cap member 60 to the lower end of the lower holder portion 131. The stamp surface of the stamp material 103 supported at the lower end of the side wall 138 is thus protected by the cap member 60.

Figure 22:
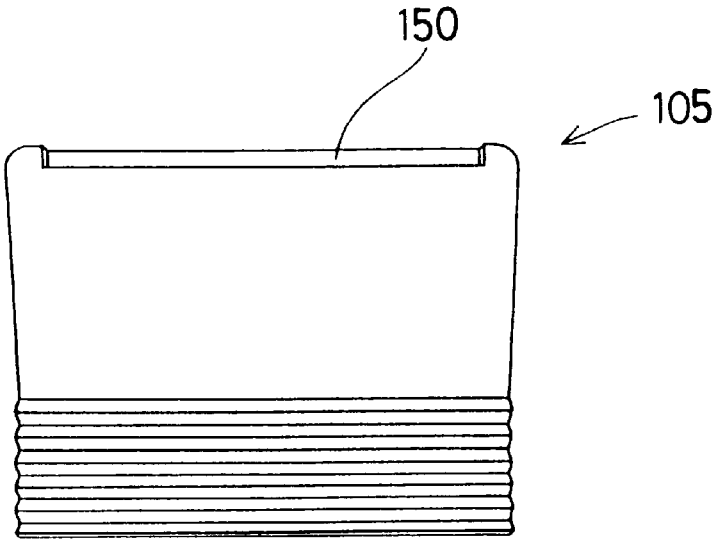
FIG. 22 is a side view of the grip member shown in FIG. 14.

Next, the grip member 105 will be described with reference to FIGS. 22 to 24. FIG. 22 is a side view, FIG. 23 is a bottom view, and FIG. 24 is a transverse sectional view of the grip member 105.

In the figures, a label portion 150 is formed on the upper surface of the grip member 105. A label to indicate the contents of the stamp formed in the stamp material 103, by the method discussed with reference to the first embodiment, is pasted on the label portion 150. Further, the insertion portion 151, which is inserted into the circumferential side wall 132 of the upper holder portion 130 of the holder member 104, is formed on the lower surface of the upper wall at the inside of the grip member 105 as shown in FIGS. 23 and 24. The insertion portion 151 acts to press against the ink pack 6 disposed in the holder member 104 through the thick paper plate 137.

Figure 23:
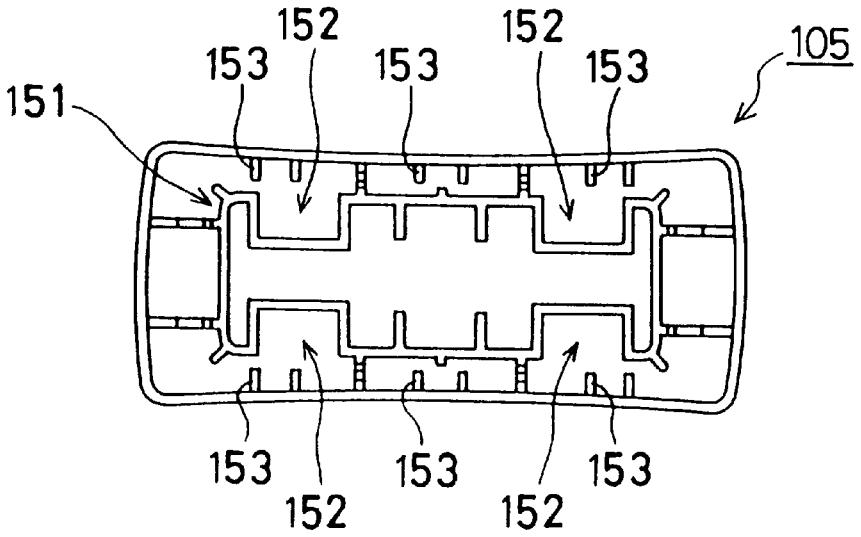
FIG. 23 is a bottom view of the grip member shown in FIG. 14.
Figure 24:
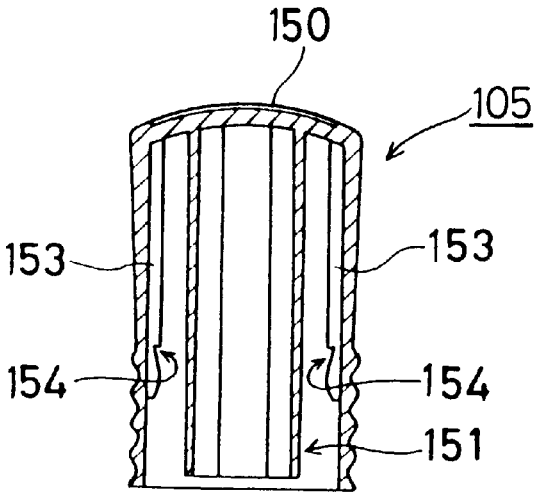
FIG. 24 is a transverse sectional view of the grip member shown in FIG. 14.

The insertion portion 151 is shaped in a substantially rectangular configuration as viewed from the bottom (FIG. 23). Four concave portions 152 are formed at opposed positions in the insertion portion 151. The concave portions 152 are provided at positions where the ink supply holes 126 are formed along the circumferential side wall 132 to permit the inserting portion 151 of the grip member 105 to be inserted into the circumferential side wall 132 of the holder member 104. Further, a plurality of ribs 153 with rib engaging grooves 154 at a lower end are formed in a vertical direction on the inner surface of the outer wall of the grip member 105. The rib engaging grooves 154 engage the grooves 133 formed on the upper surface of the circumferential side wall 132, to join the holder member 104 and the grip member 105.

Here, the cap member 60 of the stamp unit 101 is same as the cap member 60 of the stamp unit 1 used in the first embodiment. Thus, the description for the cap member 60 is described in detail with reference to FIGS. 11 and 12.

Figure 25:
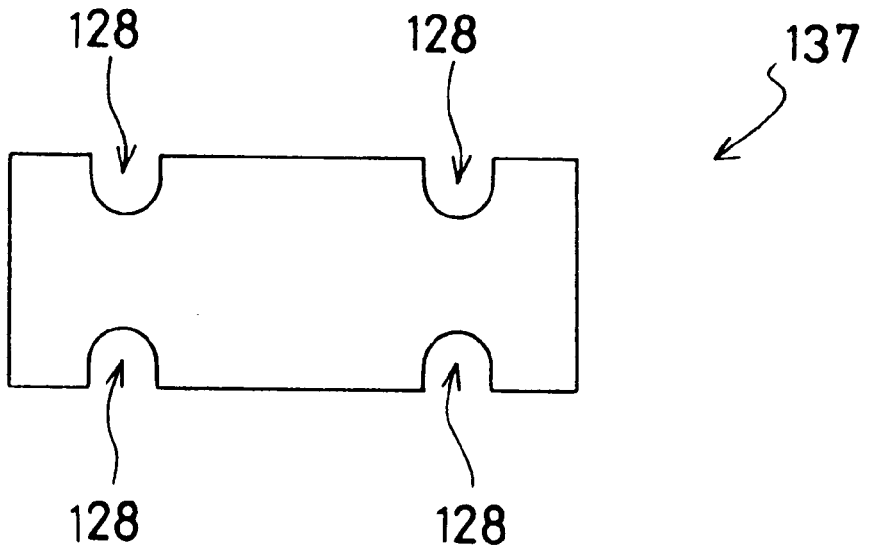
FIG. 25 is a top view of the thick paper plate shown in FIG. 14.

Further, as shown in FIG. 25, the thick paper plate 137 has four concave portions 128 corresponding to the flat shape of the ink pack storing portion 122 of the holder member 104 and is formed a little bit larger than the inner size of the ink pack storing portion 122. As shown in FIG. 15, if the grip member 105 is moved downward against the holder member 104 when an ink pack 6 is located in the ink pack storing portion 122, the pressing power from the grip member 105 is exerted on the ink pack 6 substantially uniformly by the thick paper plate 137.

Thus, the ink pack 6 is sandwiched between the bottom surface 123 of the ink pack storing portion 122 and the thick paper plate 137 and the ink pack 6 is cut and opened by the cutting rib 125. Then, as shown in FIG. 16, the ink pack 6 is pressed between two flat planes, therefore ink in the ink pack 6 flows downward through the ink flow hole 124 and is supplied to the stamp material 103. Thus, by sandwiching the ink pack 6 between two flat planes, the bottom surface 123 of the ink pack storing portion 122 and the thick paper plate 137, the ink flows without any ink remaining in the ink pack 6 and the ink is supplied to the stamp material 103 without waste.

That is to say, in case of the stamp unit 101 of the second embodiment, because the ink pack 6 stored in the ink pack storing portion 122 is pressed against the bottom surface 123, a flat surface, supporting the ink pack 6 and opened by the cutting rib 125, ink remaining in the ink pack 6 is reduced compared with the case where the surface supporting the ink pack 6 is not a flat surface but a rough surface. Therefore, the number printings per ink pack can be increased.

Although, in the second embodiment, the ink pack 6 is pressed in the axial direction by the flat surface of the thick paper plate 137, if at least the bottom surface 123, as an ink pack supporting surface, is a flat surface, the ink remaining in the ink pack 6 is reduced more than the before. However, if the thick paper plate 137 is used, as ink is extracted from the ink pack 6 by the flat surfaces applied at both the upper and lower sides, the ink remaining in the ink pack 6 can be reduced even more.

Further, in the stamp unit 101 of the second embodiment, the cutting rib 125 for cutting the ink pack 6 projecting from the bottom surface 123 is provided within the ink flow hole 124. Therefore, the ink pack 6 can be opened easily by the cutting rib 125 when the grip member 105 and the holder member 104 are combined. Further, as the cut rib 125 is provided in the ink flow hole 124, the cutting portion of the ink pack 6 opposes the ink flow hole 124. Therefore, the ink flows from the ink pack 6 into the ink flow hole 124 quickly. Therefore, the time it takes for ink to reach the stamp material 103 after the ink pack 6 is opened is shortened. Further, even if the cutting rib 125 is not provided, the ink pack can be opened by sandwiching the ink pack 6 between the bottom surface 123 of the ink pack storing portion 122 and the thick paper plate 137. However, the second embodiment has the advantage of that it needs less power to cut the ink pack 6 by providing the cutting rib 125.

Further, as the side edge of the thick paper plate 137 can be adjusted (cut) if necessary, the thick paper plate 137 can be easily disposed in the holder member 104 on the upper side of the ink pack 6. Also, the thick paper plate 137 can be fixed at the desired position in the holder member 104. Thereby, the stamp unit 101 can be transported with the ink pack 6 in place in the holder member 104. Further, because the thick paper plate 137 is capable of absorbing ink, the thick paper plate 137 absorbs any ink that flows from the ink pack 6 toward the upper side and prevents ink from leaking from the stamp unit 101.

Next, the stamp material 103 for the stamp unit 101 of the second embodiment will be described. As shown in FIGS. 14 to 16, the stamp material 103 is formed having a three layer structure. An upper layer 71 is made of a hard porous resin approximately 3 mm thick, such as a polyvinyl formal of 90% porosity. A middle layer 72 is made of a hard porous resin, approximately 2 mm thick, such as the same material as the upper layer 71. A lower layer 73 is made of a soft porous resin, such as a urethane resin of 65% porosity, with a light energy absorption material, such as carbon black, being dispersed therein. The middle layer 72 and the lower layer 73 are adhered to each other by an adhesive agent pasted in a lattice shape. The upper layer 71 and the middle layer 72 are not adhered artificially.

The three layer structure of the stamp material 103 has an advantage as follows. That is to say, it is desired that the number of printings after ink is supplied using the ink pack be in the range of 5,000 to 10,000 printings. For that, the thickness of the hard porous resin of the stamp material must be increased. However, if the thickness of the hard porous resin is increased too much, too many burrs occur while cutting and processing to the predetermined shape. If there are too many burrs, the desired shape of the resin layer cannot be obtained or an additional cutting or finishing process will be necessary. Therefore, in the second embodiment, the thickness per a layer is minimized and the overall thickness of the hard porous resin is ensured by using a plurality of hard porous resin layers. The problem of burrs is avoided in such a case and the ink can be stored in more than the desired amount in the hard porous resin layers.

Further, the ink supply holes 126 penetrate from the vicinity of the upper end of the circumferential sidewall 132 of the holder member 104 to open substantially opposite to the upper layer 71 of the stamp material 103. Although the number of the ink supply holes 126 is four in the embodiment, the number is preferably changed based on the size of the holder member 104. Using the ink supply holes 126, of a number determined based on the size of the holder member 104, users can supply ink easily and quickly when the ink stored in the stamp material 103 runs short. The ink supply holes 126 are provided in the vicinity of the side end portion of the holder member 104 for ease in supplying ink by the users.

Figure 26:
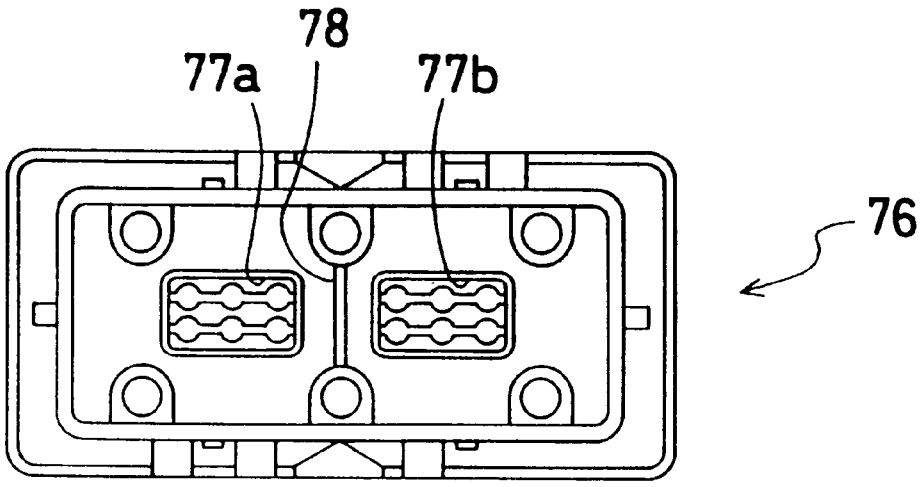
FIG. 26 is a top view of another example of the holder member shown in FIG. 14.

Only one ink flow hole 124 is provided at the center of the bottom surface 123 of the ink pack storing portion 122 in the holder member 104 of the stamp unit 101 of the second embodiment. However, the number of the ink flow holes 124 is preferably changed based on the size of the holder member 104. For example, as shown in FIG. 26, two ink flow holes 77*a,* 77*b* may be provided in the holder member 76 which is larger than holder member 104. Further, as shown, the number of the ink supply holes 126 may also be increased (to six in this case). By providing the number of ink supply holes 126 based on the size of the holder member, ink can be supplied quickly up to the side end portions of the stamp material 103 especially when the holder member 104 is larger. Therefore, the stamp printing density becomes substantially uniform over the entire surface. Also the time it takes for ink to uniformly reach the stamp material 103, after the ink pack 6 is opened, can be greatly reduced if there are more ink flow holes.

Further, in the example shown in FIG. 26, a partition rib 78 of several millimeters in height is provided on the center portion of the bottom surface 123 of the ink pack storing portion 122. The partition rib 78 acts to divide the bottom surface 123 of the ink pack storing portion 122 into left and right regions. When the partition rib 78 is provided, a slit (not shown) is provided in the grip member 105 complimentary to the partition rib 78. The partition rib 78 is provided between the ink supply holes 77*a,* 77*b* as a partition member. It prevents the ink packs from sliding from their predetermined portions when an ink pack is used for each ink supply hole 77*a,* 77*b*. If the height of the partition rib 78 is high, dividing the thick paper plate 137 into two pieces prevents the partition rib 78 from contacting the thick paper plate 137 and precluding the ink pack 6 from being pressed.

That is to say, if the partition rib 78 is not provided, and the ink packs 6 may pile up on one another and an ink pack may not lie over one of the ink supply holes. As a result, providing two or more ink supply holes may be meaningless. However, by providing the partition rib 78, movement of the ink packs 6 in the ink pack storing portion 122 is prevented. In the example of FIG. 26, it is necessary that an ink pack 6 be located above each ink supply hole 77*a,* 77*b*. If the partition rib 78 is not provided, as an alternative, a simple large size ink pack 6 may be provided.

In order to produce the stamp unit 101, first, the holder member 104 is set to the predetermined processing position of the stamp producing apparatus (not shown) by the cam action between the inclined surface of the inclined groove 143 formed at the lower holder portion 131 and the positioning member of the positioning mechanism. Further, the size of the holder member 104 is specified by the detecting grooves 144 in corporation with the groove sensor of the positioning mechanism.

A roll-shaped transparent film is transported within the stamp producing apparatus. As the film is transported, character and image data are printed thereon using a thermal head and an ink transfer ribbon of the stamp producing apparatus to produce a positive copy of the desired stamp image. The positive copy and the stamp material 103 are then set so as to oppose each other with a transparent acrylic plate provided therebetween. When a light emitting member, such as a xenon tube, emits light under this condition, the lower portion 73 of the stamp material 103 is lighted through the positive copy. Only the part of the lower portion 73 of the stamp material 103, which is lighted through the transparent portion of the positive copy, is melted, and, as a result, solidified and sealed. The lower portion 73 of the stamp material 103, which has neither melted nor solidified, remains as it is and is in the form of characters and the like of the desired image. Thereby, the stamp plate, including both a sealed portion and an unsealed portion, is produced on the lower surface of the stamp material 103.

After the stamp material 103 is processed, the coil portion of the torsion springs 16 are positioned on the positioning protrusions 18 and the holder member 104 is inserted in the inserting hole 10 of the skirt member 2 while the spring engaging portions 17, at each end, are engaged with an end of the respective torsion spring 16. At this time, the inclined protrusions 135, which are formed on the outer end surfaces of the circumferential side wall 132 of the upper holder portion 130 of the holder member 104, are slid upward in the vertical grooves 19 of the skirt member 2. Further, the other end of each of the torsion springs 16 passes over the inclined surface and engages the lower portion of the respective inclined protrusion 135. At this time, the holder member 104 is pushed upwardly, in the skirt member 2, by the power of the torsion springs 16 and the holder member 104 is slidable downwardly against the upward force of the torsion springs 16.

After the holder member 104 and the skirt member 2 are assembled as mentioned above, the inserting portion 151 of the grip member 105 is inserted into the circumferential side wall 132 of the holder member 104, as shown in FIG. 15. The ink pack 6 in the holder member 104 is sandwiched and pressed between the thick paper plate 137 and the cutting rib 125 when the grip member 105 is then pressed downwardly. The thick paper plate 137 spreads the downward force substantially uniformly across the surface of the ink pack 6. Therefore, the ink pack 6 is cut and opened at the portion contacting the cutting rib 125. Because the ink pack 6 is opened at substantially a center portion, according to the forming position of the cutting rib 125, ink flow in from the ink pack 6 to be dispersed substantially uniformly around the cutting rib 125 to be supplied to the stamp material 103 in what is substantially a one-step process. Further, because the thick paper plate 137 is capable of absorbing ink, it absorbs ink that flows from the ink pack 6 to its upper side and prevents the ink from leaking from the stamp unit 101.

Further, the ink flows at once when the ink pack 6 is opened by the cutting rib 125. However, as the space formed between the side wall 132 and the cutting rib 125 is a storing portion for the ink flowing from the ink pack 6, ink leakage from the holder member 104 is prevented even if ink flows at once when the ink pack 6 is opened.

Ink flowing from the ink pack 6 is guided downwardly by the ink flow hole 124 formed around the cutting rib 125 and pools on the stamp material 103 for a while (FIG. 16 shows this state.). The ink then impregnates the stamp material 103 after several minutes. At this time, because the ink flow hole 124 is formed around the cutting rib 125 and the supporting rods 127 are provided downward of the ink flow hole 124, ink from the ink pack 6 is dispersed completely over the bottom portion of the holder member 104, and the ink uniformly impregnates the stamp material 103.

Further, when the ink pack 6 is opened by moving the grip member 105 downward, the rib engaging grooves 154, which are formed at the lower end of each rib 153 of the grip member 105, are fitted into corresponding grooves 133 formed on the circumferential side wall 132 of the holder member 104. Thus, holder member 104 and the grip member 105 are connected. Therefore, if a user wants to perform stamp printing of the characters of the stamp plate formed on the stamp material 103 after ink impregnates the stamp material 103 as mentioned above, the grip member 105 and the holder member 104 move integrally, to perform the stamp printing.

Further, if the stamp printing cannot be performed at the proper density because ink impregnating the stamp material 103 runs out, stamp printing can be started again by removing the grip member 105 from the holder member 104, then removing the thick paper plate 137 and depleted bag-shaped ink pack 6 from the holder member 104, and setting a new ink pack 6 within the holder 104. Then the operations described above are again performed for stamp printing. Further, the stamp printing can be started again by supplying ink through the ink supply holes 126 formed on an inner surface of the circumferential side wall 132 of the holder member 104 without removing the ink pack 6 and the thick paper plate 137.

As described above, the supply ink to the stamp material 103 of the stamp unit 101 of the second embodiment, the grip member 105 is pressed downward toward the ink pack 6 provided in the holder member 104, the ink pack 6 is thereby sandwiched between the thick paper plate 137 and the cutting rib 125 and opened. Thereby, ink in the ink pack 6 flows downward through the ink flow hole 124 and is supplied to the stamp material 103. Thus, ink can be supplied to the stamp material 103 very easily in one step.

Further, if it is necessary to supply ink to the stamp material 103 because ink impregnated into the stamp material 103 runs short by repeated stamp printing, and the density of printing characters declines, the stamp printing can be resumed after supplying ink by the simple process of replacing the ink pack 6.

Further, as the cutting rib 125 contacting the ink pack 6 and the ink supply hole 124 for supplying ink into the stamp material 103 are provided, the ink pack 6 can be opened easily and quickly by the cutting rib 125, so that ink flows from the ink pack 6 to quickly impregnate the stamp material 103.

Ink flowing from the ink pack 6 is guided downwardly by the ink flow hole 124 formed around the cutting rib 125 and impregnates the stamp material 103. Because the ink flow hole 124 is formed around the cutting rib 125 and the supporting rods 127 are downwardly of the ink flow hole 124, ink from the ink pack 6 is uniformly dispersed over the bottom portion of the holder member 104, so that ink uniformly impregnates the stamp material 103.

Although preferred embodiments of the invention have been described, they are not intended to limit the invention to the foregoing of the embodiments, and modifications and variations are possible without departing from the spirit of the invention.

For example, in the stamp unit 101 of the second embodiment, although the stamp material 103 is comprised of three layers, such as two hard porous resin layers and one soft porous resin layer, the stamp material 103 may include four or more layers by providing three or more layers of the hard porous resin layers. Further, the shape or location of the ink supply hole(s) can be changed.

What is claimed is:

1. A stamp unit, comprising:

a skirt member;

a holder member slidably disposed within the skirt member for movement in an axial direction, a holder member holding a stamp material at the lower end portion, the holder member including a bottom portion having at least an ink flow hole opposing the stamp material;

a grip member disposed above the holder member, the grip member moving the holder member downwardly; and a bag-shaped ink pack made of a film material, the ink pack being filled with ink, and stored on the bottom portion of the holder member within the holder member, wherein, when the holder member is moved downwardly by said grip member, said ink pack is sandwiched and pressed between a lower end portion of the grip member and the bottom portion of the holder member to open the ink pack.

2. The stamp unit according to claim 1, wherein said holder member further includes a cutting portion disposed on the bottom portion of the holder member, the cutting portion contacting the ink pack; when the ink pack is pressed by the lower end portion of the grip member, the ink pack is opened by cooperation of the lower end portion and the cutting portion, and ink flows from the ink pack into the stamp material through the ink flow hole, whereby the stamp material is impregnated with ink.

3. The stamp unit according to claim 2, wherein said cutting portion includes a cutting rib formed at a substantially center position of the bottom portion of the holder member and the ink flow hole is formed around the cutting rib.

4. The stamp unit according to claim 3, wherein the holder member includes a side wall slid within the skirt member, and a plurality of supporting ribs disposed on an inner surface of the side wall, the plurality of supporting ribs supporting the ink pack in cooperation with said cutting rib, the plurality of supporting ribs having substantially a same height as the cutting rib.

5. The stamp unit according to claim 4, wherein the holder member includes an ink storing portion for storing ink flowing from the ink pack when the ink pack is opened, the ink storing portion being disposed above the bottom portion of the holder member, the ink storing portion being a space formed between the side wall and the cutting rib.

6. The stamp unit according to claim 1, wherein the bottom portion of the holder member is flat.

7. The stamp unit according to claim 6, wherein said holder member includes a cutting portion for cutting the ink pack, the cutting portion being disposed in the ink flow hole, the cutting portion protruding beyond a surface of the bottom portion of the holder member.

8. The stamp unit according to claim 7, wherein a number of ink flow holes is related to a size of the holder member.

9. The stamp unit according to claim 8, wherein the holder member includes a plurality of ink flow holes, and at least a partition member disposed between two ink flow holes of the plurality of ink flow holes.

10. The stamp unit according to claim 1, further including a flat member disposed between the ink pack and the lower end portion of the grip member within the holder member, wherein when the holder member is moved downwardly by said grip member, the ink pack is sandwiched and pressed between the flat member and the bottom portion of the holder member, and thereby the ink pack is opened.

11. The stamp unit according to claim 10, wherein said holder member includes at least a positioning protrusion for positioning and fixing said flat member within the holder member, the positioning protrusion being formed on an inner surface of a side wall of the holder member.

12. The stamp unit according to claim 11, wherein the positioning protrusion has a wedge shape declining from the inner surface of the side wall to inside of the holder member.

13. The stamp unit according to claim 10, wherein the flat member is ink absorbent.

14. The stamp unit according to claim 13, wherein the flat member is made of a thick paper.

15. The stamp unit according to claim 10, wherein the bottom portion of the holder member is flat.

16. The stamp unit according to claim 1, wherein the stamp material has at least a porous resin layer including at least a light energy absorbing material.

17. A method for supplying ink into a stamp material of a stamp unit comprising a skirt member, a holder member slidably disposed within the skirt member in an axial direction, the holder member holding a stamp material at a lower end portion, the holder member including a bottom portion having at least an ink flow hole opposing the stamp material, a grip member disposed above the holder member, the grip member moving the holder member downwardly, comprising the steps of:

disposing a bag-shaped ink pack within the holder member, the ink pack made of a film material, and filled with ink;

moving the holder member downwardly using the grip member, thereby sandwiching and pressing the ink pack between the lower end portion of the grip member and the bottom portion of the holder member, to open the ink pack; and impregnating ink flowing from the ink pack into the stamp material through the ink flow hole.

18. An ink stamp unit, comprising:

a skirt member having a lower skirt portion and an upper skirt portion;

a holder member received in, and engaged with, the skirt member for slidable movement therein, the holder member having:

a stamp material mounted to one end;

a bottom surface for an ink receiving area;

a retention mechanism proximate an end opposite to the one end; and a force generating mechanism that maintains the holder member in a housed position in the skirt member;

an ink pack received on the bottom surface; and a grip member for attachment to the holder member by means of the retention mechanism, the grip member having an insertion portion seated with the holder member opposite the bottom surface with the ink pack therebetween.

19. The ink stamp unit according to claim 18, further comprising a flat plate mounted in the holder member between the insertion portion of the grip member and the ink pack.

20. The ink stamp unit according to claim 18, wherein the bottom surface has a cutter rib surrounded by at least one ink flow hole.

* * * * *